US010795307B2

(12) United States Patent
Saito

(10) Patent No.: US 10,795,307 B2
(45) Date of Patent: Oct. 6, 2020

(54) IMAGE FORMING APPARATUS HAVING WITHDRAWING MECHANISM AND WITHDRAWAL HOLDING MECHANISM

(71) Applicant: Oki Data Corporation, Tokyo (JP)

(72) Inventor: Takashi Saito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/563,927

(22) Filed: Sep. 9, 2019

(65) Prior Publication Data

US 2020/0103818 A1 Apr. 2, 2020

(30) Foreign Application Priority Data

Sep. 27, 2018 (JP) ..... 2018-182895

(51) Int. Cl.
*G03G 21/16* (2006.01)

(52) U.S. Cl.
CPC ..... *G03G 21/1633* (2013.01)

(58) Field of Classification Search
USPC ..... 399/125
See application file for complete search history.

(56) References Cited

U.S. PATENT DOCUMENTS

2007/0160384 A1* 7/2007 Sakurai ..... G03G 21/1647 399/110
2010/0098459 A1* 4/2010 Hoashi ..... G03G 21/1853 399/114
2011/0002705 A1* 1/2011 Kakitani ..... G03G 21/1633 399/90
2012/0163857 A1* 6/2012 Kamimura ..... G03G 21/1633 399/110
2012/0207511 A1* 8/2012 Sato ..... G03G 21/1633 399/110
2012/0294646 A1* 11/2012 Suzuki ..... G03G 21/1661 399/111
2013/0071139 A1* 3/2013 Fukao ..... G03G 21/1633 399/110
2013/0195505 A1* 8/2013 Hashimoto ..... G03G 21/1671 399/110
2018/0052423 A1* 2/2018 Hwang ..... G03G 21/1867

FOREIGN PATENT DOCUMENTS

JP 2010-102283 A 5/2010

* cited by examiner

*Primary Examiner* — Quana Grainger
(74) *Attorney, Agent, or Firm* — Metrolex IP Law Group, PLLC

(57) ABSTRACT

An image forming apparatus according to an embodiment may include: an apparatus body; a first cover attached to the apparatus body to open and close a first opening of the apparatus body; a second cover attached to the apparatus body to open and close a second opening of the apparatus body; an image forming section in the apparatus body configured to form a latent image and including a first contact part; a second contact part provided to the apparatus body and opposed to the first contact part; a withdrawing mechanism that moves along with movement of the first cover to bring the second contact part into contact with and separated away from the first contact part; and a withdrawal holding mechanism that moves along with movement of the second cover and holds the separation of the second contact part from the first contact part.

15 Claims, 14 Drawing Sheets

IMAGE FORMING APPARATUS HAVING WITHDRAWING MECHANISM AND WITHDRAWAL HOLDING MECHANISM

CROSS REFERENCE TO RELATED APPLICATIONS

This application claims priority based on 35 USC 119 from prior Japanese Patent Application No. 2018-182895 filed on Sep. 27, 2018, entitled "IMAGE FORMING APPARATUS", the entire contents of which are incorporated herein by reference.

BACKGROUND

The disclosure relates to an image forming apparatus, and is suitable to be applied to, for example, an electrographic image forming apparatus whose covers are opened to allow an image forming unit to be replaced.

In a related art, an image forming apparatus has been widely used in which an image forming section for forming an image prints the image by: irradiating the surface of a photoconductor drum with exposure light from an exposure head for outputting the exposure light emitted from a light emitting diode (LED) as a light emitting element, thereby forming a latent image on the surface of the photoconductor drum; and attaching toner to the latent image, thereby developing the latent image. Such an image forming apparatus drives the image forming section by, supplying electric power from a contact part provided at a housing or a body of the apparatus to a contact part provided at the image forming section in a state where they are in contact with each other.

In addition, a proposal has been made to construct the image forming apparatus which moves the contact part of the apparatus body along with movement of a basket that supports the image forming section (see, for example, Patent Document 1).

Patent Document 1: Japanese Patent Application Publication No. 2010-102283

SUMMARY

In the image forming apparatus, when the basket moves, the contact part of the apparatus body may slide on the contact part of the image forming section, and contact failure may be caused by influence of abrasion of the contact parts and abrasion powder.

An embodiment according to the disclosure proposes an image forming apparatus capable of improving its reliability.

An aspect of the disclosure may be an image forming apparatus that includes: an apparatus body; a first cover attached to the apparatus body to open and close a first opening of the apparatus body; a second cover attached to the apparatus body to open and close a second opening of the apparatus body; an image forming section in the apparatus body configured to form a latent image and including a first contact part; a second contact part provided to the apparatus body and opposed to the first contact part; a withdrawing mechanism that moves along with movement of the first cover to bring the second contact part into contact with and separated away from the first contact part; and a withdrawal holding mechanism that moves along with movement of the second cover and holds the separation of the second contact part from the first contact part.

According to the aspect, the second contact part of the apparatus body can be held in a contact point withdrawn state even when the first cover is closed in the state where the second cover is opened. Thus, the aspect may prevent the second contact part of the apparatus body from coming into contact with the first contact part of the image forming section, no matter which sequence the first cover and the second cover are closed in.

Accordingly, the aspect may be able to realize the image forming apparatus capable of improving its reliability.

DETAILED DESCRIPTION

Figure 1:
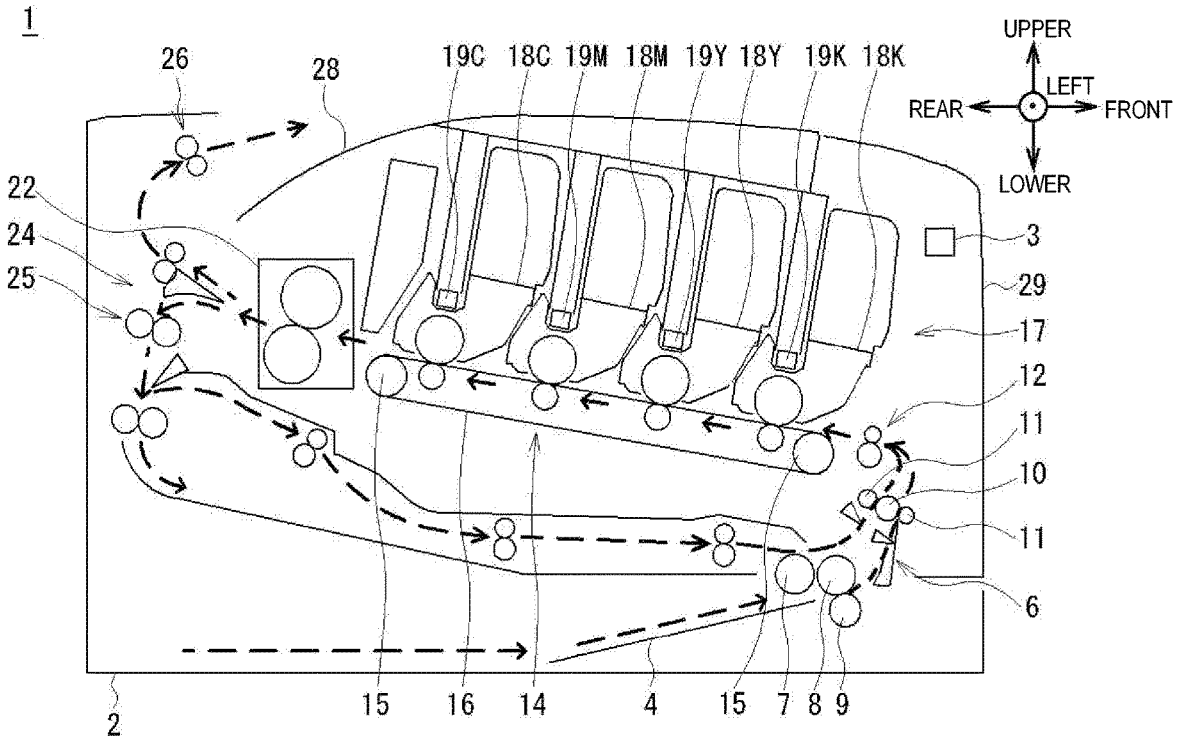
FIG. 1 is a diagram illustrating a left side view of a configuration of an image forming apparatus.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. Embodiment

[1-1. Configuration of Image Forming Apparatus]

As illustrated in a left side view of FIG. 1, an image forming apparatus 1 is a color electrographic printer which prints a desired color image, for example, on an A3-size sheet, an A4-size sheet and the like. The image forming apparatus 1 includes: a substantially box-shaped printer housing 2 which has a predetermined internal space; and various parts arranged inside the printer housing 2. The printer housing 2 constitutes all of or a main part of an apparatus body of the image forming apparatus 1. The following descriptions are provided with a front of the image forming apparatus 1 defined as a right end portion of the image forming apparatus 1 illustrated in FIG. 1, or a portion of the image forming apparatus 1 in which a front cover 29 is arranged, with up and down defined as higher and lower positions which are in the vertical direction relative to the front, with left and right defined as positions which are in the left-right direction relative to the front, and with front and rear defined as positions which are in the front-rear direction relative to the front. A controller 3 integrally controls all the image forming apparatus 1. The controller 3 is connected to a host apparatus (not illustrated), such as a personal computer, wirelessly or by wire via a communication processor (not illustrated). Upon receipt of image data on a color image for printing and an instruction to print the color image on a sheet from the host apparatus, the controller 3 performs a printing process to form a printed image on the sheet.

A lowermost portion of the inside of the printer housing 2 is provided with: a feed medium tray 4 in which contain sheets; and a sheet feeder 6 which separates and feeds, one-by-one, the sheets stacked in the feed medium tray 4. The sheet feeder 6 is located above a front end of the feed medium tray 4. The sheet feeder 6 includes: multiple rollers such as a pickup roller 7, a sheet-feeding roller 8, a separation roller 9, a registration roller 10, pressure rollers 11 and a conveyance roller section 12; and a guide and the like which guide sheets. The pickup roller 7 is provided above the front end of the feed medium tray 4, and faces an upper surface of the feed medium tray 4. While rotating counterclockwise in FIG. 1, the pickup roller 7 sends out the sheets from the feed medium tray 4 toward a conveyance path. The sheet-feeding roller 8 is provided behind, or downstream of, the pickup roller 7 in a sheet-feeding direction. Upon the sheets sent out by the pickup roller 7, the sheet-feeding roller 8 feeds out the sheets to the conveyance path by rotating counterclockwise in FIG. 1. The separation roller 9 is arranged under and opposite the sheet-feeding roller 8. While the sheet-feeding roller 8 are feeding out the sheets sent out from the feed medium tray 4, the separation roller 9 stops its rotation each time it receives a sheet, and thereby separates the sheet from the others. The registration roller 10 and the pressure rollers 11 are arranged opposite, and in pressure contact with, each other. When receiving the sheets fed out from the feed medium tray 4, the registration roller 10 and the pressure rollers 11 correct the skew of the sheets. In the conveyance roller section 12, rollers are arranged opposite, and in pressure contact with, each other. After receiving the sheets whose skew is corrected by the registration roller 10 and the pressure rollers 11, the conveyance roller section 12 conveys the sheets to a transfer unit 14.

Under control of the controller 3, the sheet feeder 6 rotates the pickup roller 7, the sheet-feeding roller 8, the separation roller 9, the registration roller 10, the pressure rollers 11 and the conveyance roller section 12 to receive the sheets having been contained in the feed medium tray 4 while separating one sheet from the others, and to advance the received sheets by moving the sheets to an upper front of the sheet feeder 6 and thereafter turning the sheets toward the rear of the printer housing 2 at a position near, and substantially in the vertical middle of, the front end of the printer housing 2.

Inside the printer housing 2, the transfer unit 14 is provided over the feed medium tray 4 in a way that makes the transfer unit 14 traverse the inside of the printer housing 2 to a large extent in the front-rear direction. The transfer unit 14 includes: two elongated cylindrical rollers 15 each having a central axis extending in the left-right direction, one roller 15 arranged behind the other roller 15 in the front-rear direction; and a conveyance belt 16 stretched between the front and rear rollers 15 while looped around each of the rollers 15. The conveyance belt 16 is formed as an endless belt which is wide in the left-right direction, and runs along with the rotations of the rollers 15. Based on control by the controller 3, the transfer unit 14 rotates the rollers 15 to make the conveyance belt 16 run. The upper surface of the conveyance belt 16 receives each sheet from the sheet feeder 6, and conveys the sheet toward the rear.

Meanwhile, an image forming section 17 is provided over the transfer unit 14, that is to say, in an upper half of the inside of the printer housing 2. The image forming section 17 includes four image forming units 18C, 18M, 18Y, 18K (hereinafter generically referred to as "image forming units 18") arranged from the rear to the front in this order. The image forming units 18 of the respective colors are arranged tandem. In other words, the image forming units 18C, 18M, 18Y, 18K correspond respectively to cyan (C), magenta (M), yellow (Y) and black (K). The image forming units 18C, 18M, 18Y, 18K have the same configuration, and are different from one another only in terms of their respective colors. The image forming units 18 are each formed in a box-like shape relatively long in the left-right direction. The image forming units 18 are detachably supported by a basket 30 illustrated in FIGS. 2 and 3.

Inside the printer housing 2, light-emitting diode (LED) heads 19C, 19M, 19Y, 19K (hereinafter generically referred to as "LED heads 19") are provided under a top cover 28 (described later), corresponding respectively to the image forming units 18C, 18M, 18Y, 18K. The LED heads 19 are each formed in a right-angled parallelepiped elongated in the left-right direction. Inside each LED heads 19, multiple LEDs are arranged in the left-right direction. The LED head 19 makes the LEDs emit light according to the image data supplied from the controller 3. Each image forming unit 18 is configured such that when installed in the printer housing 2, the image forming unit 18 is arranged very close to the corresponding LED head 19, and performs an exposure process using the light from the LED head 19.

Toner cartridges are connected to the upper portions of the image forming units 18C, 18M, 18Y, 18K, respectively. The toner cartridges are hollow containers long in the left-right direction, and contain the corresponding color powder toners. A predetermined stirring mechanism is incorporated in each toner cartridge.

The controller 3 supplies the toners from the toner cartridges to the image forming units 18. In addition, the controller 3 makes the LED heads 19 emit the light to form light-emitting patterns according to the image data supplied from the host apparatus (not illustrated). Accordingly, using the toners supplied from the toner cartridges, the image forming units 18 form toner images according to the light-emitting patterns formed by the LED heads 19, and transfer the toner images onto a sheet. Thereby, four color toner images according to the image data are sequentially transferred onto the sheet conveyed by the transfer unit 14.

A fuser 22 is provided behind the transfer unit 14, that is to say, near the rear end of, and near the vertical middle of, the inside of the printer housing 2. The fuser 22 includes a heat roller and a pressure roller. Based on control from the controller 3, the fuser 22 heats the heat roller, and rotates the heat roller and the pressure roller in their respective directions. Thereby, the fuser 22 fuses the toners onto the sheet received from the transfer unit 14, that is to say, the sheet with the four color toner images superposed thereon, by applying the heat and pressure to the sheet, and passes the resultant sheet to an upper rear of the fuser 22.

A sheet delivery section 24 is arranged in the upper rear of the fuser 22. The sheet delivery section 24 includes: multiple rollers such as rollers in a conveyance roller section 25 and rollers in the discharge roller section 26; and a guide and the like which guide the sheet. In the conveyance roller section 25, its rollers are arranged opposite, and in pressure contact with, each other. The conveyance roller section 25 receives the sheet from the fuser 22, and conveys the sheet to the discharge roller section 26. In the discharge roller section 26, its rollers are arranged opposite, and in pressure contact with, each other. The discharge roller section 26 receives the sheet from the conveyance roller section 25, and conveys the sheet to the top cover 28. Based on control by the controller 3, the sheet delivery section 24 rotates the rollers in the conveyance roller section 25 and the rollers in the discharge roller section 26. Thereby, after receiving the sheet from the fuser 22, the sheet delivery section 24 conveys the sheet to an upper rear of the sheet delivery section 24 and subsequently turns the sheet toward the front of the sheet delivery section 24 to discharge the sheet onto the top cover 28 formed on an upper surface of the printer housing 2.

As discussed above, the image forming apparatus 1 performs the printing process by: making the LED heads 19 emit the light; making the image forming units 18 of the respective colors form the toner images; and sequentially transferring the toner images onto the sheet.

[1-2. Configuration of Top Cover]

Figure 2:
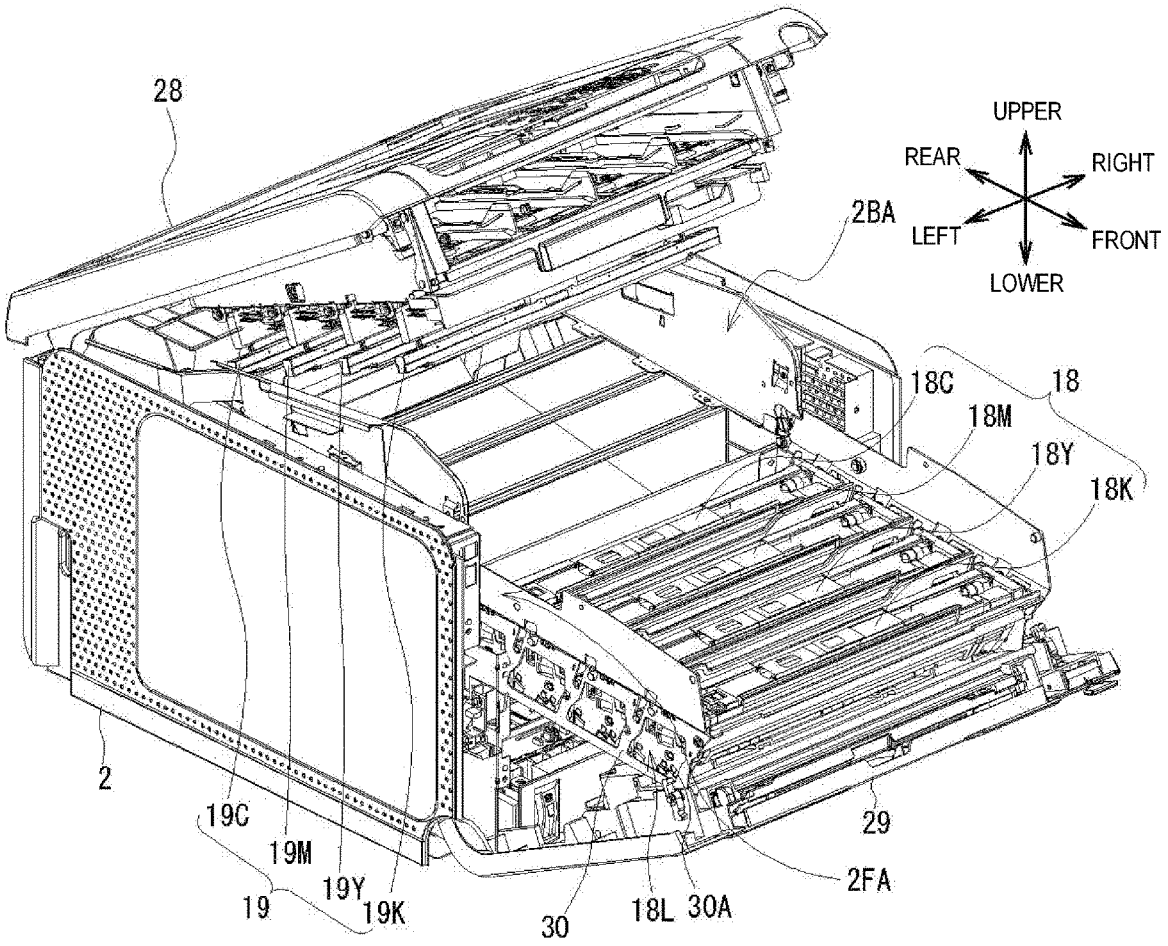
FIG. 2 is a diagram illustrating a perspective view of the configuration of the image forming apparatus with its two covers opened and with its basket pulled out.

As illustrated in FIG. 2, an upper opening 2BA is formed in the upper side of the printer housing 2, and the upper opening 2BA allows the LED heads 19 to withdraw above the image forming units 18 when the basket 30 moves between the inside and outside of the printer housing 2. Furthermore, the top cover 28 openable and closable is provided to the upper surface of the printer housing 2. The top cover 28 is turnably fixed to the printer housing 2 with the assistance of a hinge provided to a rear end portion of the top cover 28. The turn of the top cover 28 on the hinge can open and close the upper opening 2BA. In the following descriptions, a state in which the top cover 28 keeps the upper opening 2BA closed may be referred to as a top cover closed state, while a state in which the top cover 28 keeps the upper opening 2BA opened after turning upward from the top cover closed state may be referred to as a top cover opened state. As discussed above, the top cover 28 is provided with the LED heads 19, and the top cover closed state brings the LED heads 19 very close to the image forming units 18.

When performing the printing operation for printing, the image forming apparatus 1 closes the upper opening 2BA by the putting of the top cover 28 into the top cover closed state as illustrated in FIG. 1, and thereby protects the inside of the image forming apparatus 1. Meanwhile, when the user carries out maintenance work such as replacing an image forming unit 18 with a new one or removing a sheet jammed inside the image forming apparatus 1, the image forming apparatus 1 opens the upper opening 2BA in conjunction with the user's putting the top cover 28 into the top cover opened state depending on the necessity as illustrated in FIG. 2, and thereby makes it easy for the user to perform the work on the sections inside the image forming apparatus 1.

The basket 30 engages with the top cover 28 with the assistance of a member (not illustrated), and when the top cover 28 rises, the basket 30 turns and rise along with the turn of the top cover 28. Accordingly, as the top cover 28 turns from the top cover closed state to the top cover opened state, the image forming units 18 supported by the basket 30 rise together with the basket 30.

[1-3. Configuration of Front Cover]

As illustrated in FIG. 2, a front opening 2FA through which to move the basket 30 between the inside and outside of the printer housing 2 is formed in the front side of the printer housing 2. The front cover 29 openable and closable is provided in a front surface of the printer housing 2. The front cover 29 is turnably fixed to the printer housing 2 with the assistance of a hinge provided in a lower end portion of the front cover 29. The turn of the front cover 29 on the hinge makes it possible for the front opening 2FA to be opened and closed. A state in which the front cover 29 keeps the front opening 2FA closed may be hereinafter referred to as a front cover closed state, while a state in which the front cover 29 keeps the front opening 2FA opened after turning frontward from the front cover closed state may be hereinafter referred to as a front cover opened state.

When performing the printing operation for printing, the image forming apparatus 1 closes the front opening 2FA by the putting of the front cover 29 into the front cover closed state as illustrated in FIG. 1, and thereby protects the inside of the image forming apparatus 1. Meanwhile, when the user carries out maintenance work such as replacing an image forming unit 18 with a new one or removing a sheet jammed inside the image forming apparatus 1, the image forming apparatus 1 opens the front opening 2FA by the user's putting the front cover 29 into the front cover opened state depending on the necessity as illustrated in FIG. 2, and thereby makes it easy for the user to perform the work on the sections inside the image forming apparatus 1.

[1-4. Cover Opened and Closed States]

Figure 4:
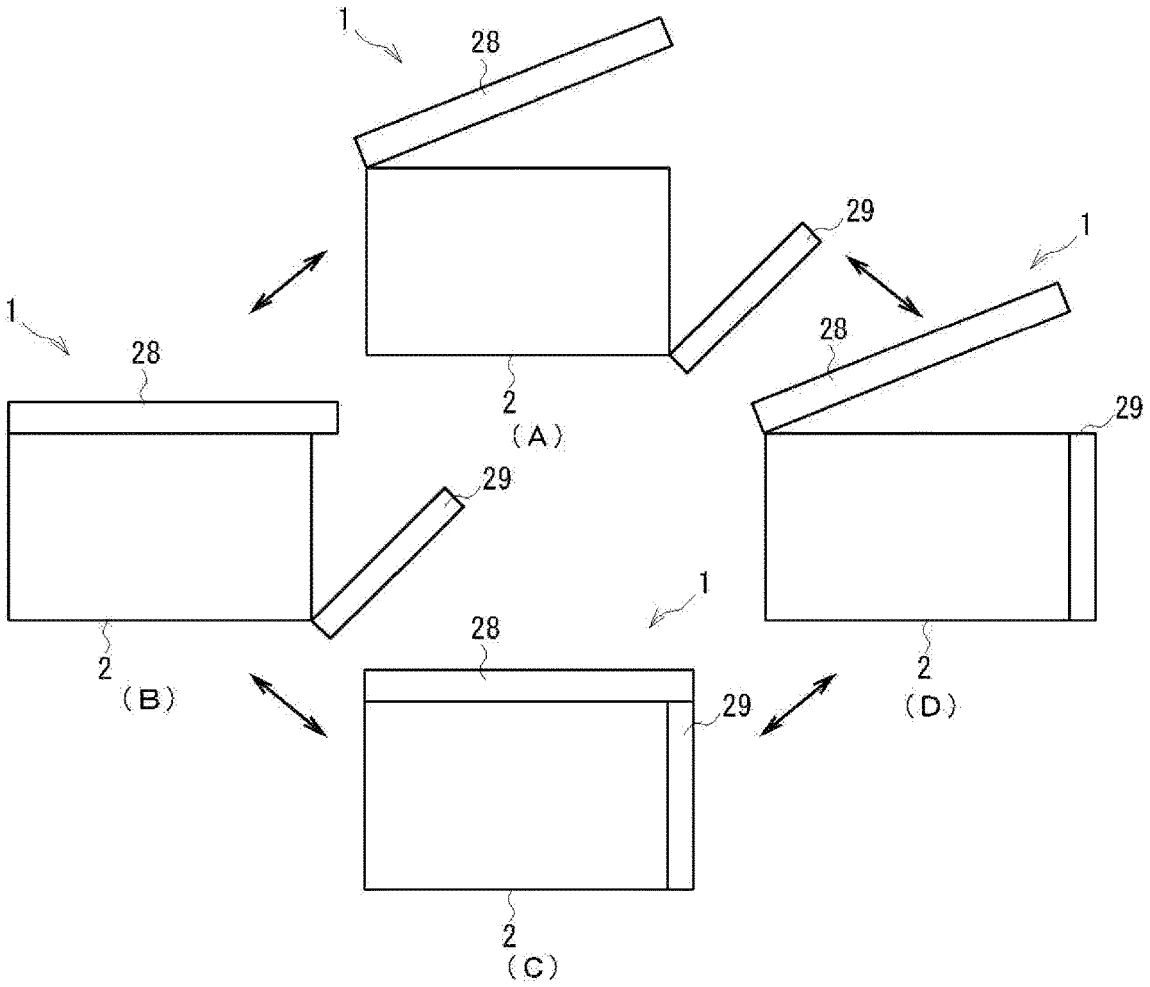
FIG. 4 is a diagram illustrating left side views (A) to (D) of how the front cover and the top cover shift between their respective opened and close states.

As illustrated in FIG. 4, the image forming apparatus 1 shifts among a two-cover opened state (FIG. 4(A)), a two-cover closed state (FIG. 4(C)), a front opened/top closed state (FIG. 4(B)) and a front closed/top opened state (FIG. 4(D)). The two-cover opened state (FIG. 4(A)) is a state in which the front cover 29 is opened and the top cover 28 is opened. The two-cover closed state (FIG. 4(C)) is a state in which the front cover 29 is closed and the top cover 28 is closed. The front opened/top closed state (FIG. 4(B)) is a state in which the front cover 29 is opened and the top cover 28 is closed. The front closed/top opened state (FIG. 4(D)) is a state in which the front cover 29 is closed and the top cover 28 is opened. The image forming apparatus 1 is capable of shifting from the two-cover opened state (FIG. 4(A)) or the two-cover closed state (FIG. 4(C)) to the front opened/top closed state (FIG. 4(B)) and the front closed/top opened state (FIG. 4(D)). Furthermore, the image forming apparatus 1 is capable of shifting from the front opened/top closed state (FIG. 4(B)) or the front closed/top opened state (FIG. 4(D)) to the two-cover opened state (FIG. 4(A)) and the two-cover closed state (FIG. 4(C)).

[1-5. Configuration in which Basket and Contact Parts are Arranged]

Figure 3:
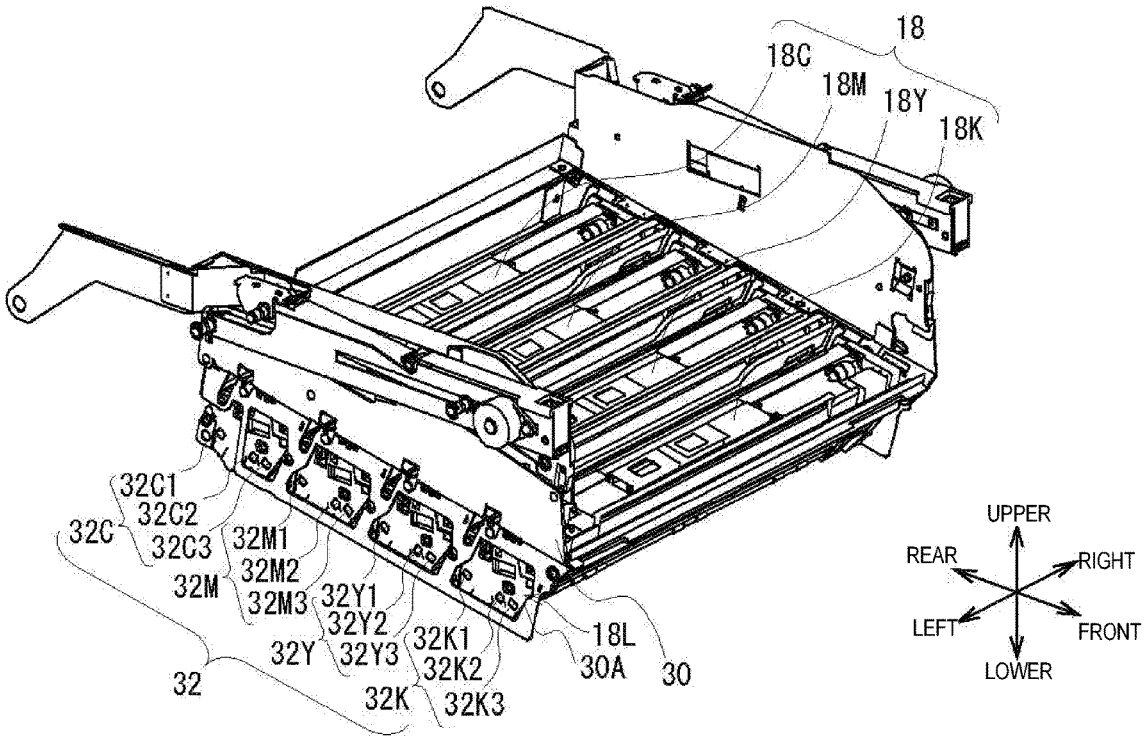
FIG. 3 is a diagram illustrating a perspective view of a configuration in which the basket and image forming units are arranged.

As illustrated in FIGS. 2 and 3, the basket 30 as a support member is provided to the printer housing 2 in a way that makes the basket 30 movable substantially in the front-rear direction while detachably supporting the image forming units 18, and in a way that makes the basket 30 movable in the up-down direction while housed in the printer housing 2. Specifically, the basket 30 and the image forming units 18 move among an image forming position, a displaced position, and a pulled-out position.

The image forming position is a position at which the image forming units 18 can form an image on a sheet while the basket 30 (FIG. 3) is in a basket housed state in which the basket 30 is housed in the printer housing 2 as illustrated in FIG. 1. The displaced position is a position to which, while in the basket housed state, the basket 30 is displaced upward from the image forming position with photoconductor drums of the respective image forming units 18 withdrawn or displaced above the conveyance belt 16, and from which the basket 30 can move outward of the front of the printer housing 2. When the top cover 28 shifts from the top cover closed state to the top cover opened state, the basket 30 is released from being pressed by a pressing member (not illustrated) of the top cover 28, and moves from the image forming position to the displaced position. As illustrated in FIG. 2, the pulled-out position is a position at which the image forming units 18 can be attached to or detached from the basket 30 while the basket 30 is in a basket pulled-out state in which the basket 30 is pulled out of the printer housing 2. After the front cover 29 shifts from the front cover closed state to the front cover opened state, when the user draws the basket 30 frontward from the displaced position, the basket 30 moves to the pulled-out position.

On the other hand, after the front cover 29 shifts from the front cover opened state to the front cover closed state, when the user pushes the basket 30 rearward from the pulled-out position and thereby places the basket 30 inside the printer housing 2, the basket 30 moves to the displaced position. Thereafter, when the top cover 28 shifts from the top cover opened state to the top cover closed state, the basket 30 is pressed by the pressing member (not illustrated) of the top cover 28, and moves from the displaced position to the image forming position.

While the basket 30 is located in the image forming position, the image forming units 18 are fixed to the respective predetermined positions, and are positioned relative to the printer housing 2. Furthermore, the image forming units 18 are provided with their respective drive receivers (not illustrated), while the printer housing 2 is provided with drive output units (not illustrated). The drive output units are connected to the drive receivers, and rotational forces are transmitted from the printer housing 2 to the image forming units 18. In addition, the image forming units 18 are provided with their respective image forming section-side contact parts 32 (FIG. 3) as first contact parts, while the printer housing 2 is provided with apparatus body-side contact parts 34 (FIG. 8) as second contact parts. The second contact parts 34 (the apparatus body-side contact parts 34) directly contact and are electrically connected to the first contact parts 32 (the image forming section-side contact parts 32), and electric power is supplied from the printer housing 2 to the image forming units 18.

As illustrated in FIGS. 2 and 3, basket opening parts 30A through which to expose left side surfaces 18L of the image forming units 18 to the left of the basket 30 are made in portions of a left side plate of the basket 30 which face the left side surfaces 18L of the image forming units.

The left side surface 18L of the image forming unit 18K is provided with first contact parts 32K1, 32K2, 32K3, as metal-made contact parts, which are arranged in this order from the rear to the front in a line in the front-rear direction. The first contact part 32K1 is used to apply a voltage to a charge roller in the image forming unit 18K. The first contact part 32K2 is used to apply a voltage to a development roller in the image forming unit 18K. The first contact part 32K3 is used to apply a voltage to a toner supply roller in the image forming unit 18K.

In addition, the image forming unit 18C is provided with first contact parts 32C1, 32C2, 32C3, like the first contact parts 32K1, 32K2, 32K3 provided to the image forming unit 18K. Furthermore, the image forming unit 18M is provided with first contact parts 32M1, 32M2, 32M3, like the first contact parts 32K1, 32K2, 32K3 provided to the image forming unit 18K. Moreover, the image forming unit 18Y is provided with first contact parts 32Y1, 32Y2, 32Y3, like the first contact parts 32K1, 32K2, 32K3 provided to the image forming unit 18K.

The first contact parts 32K1, 32K2, 32K3 are hereinafter generically referred to as "first contact parts 32K" as well. The first contact parts 32C1, 32C2, 32C3 are hereinafter generically referred to as "first contact parts 32C" as well. The first contact parts 32M1, 32M2, 32M3 are hereinafter generically referred to as "first contact parts 32M" as well. The first contact parts 32Y1, 32Y2, 32Y3 are hereinafter generically referred to as "first contact parts 32Y" as well. Moreover, the first contact parts 32K, 32C, 32M, 32Y are hereinafter generically referred to as "first contact parts 32" as well.

[1-6. Configuration of Power Supply Board]

Figure 8:
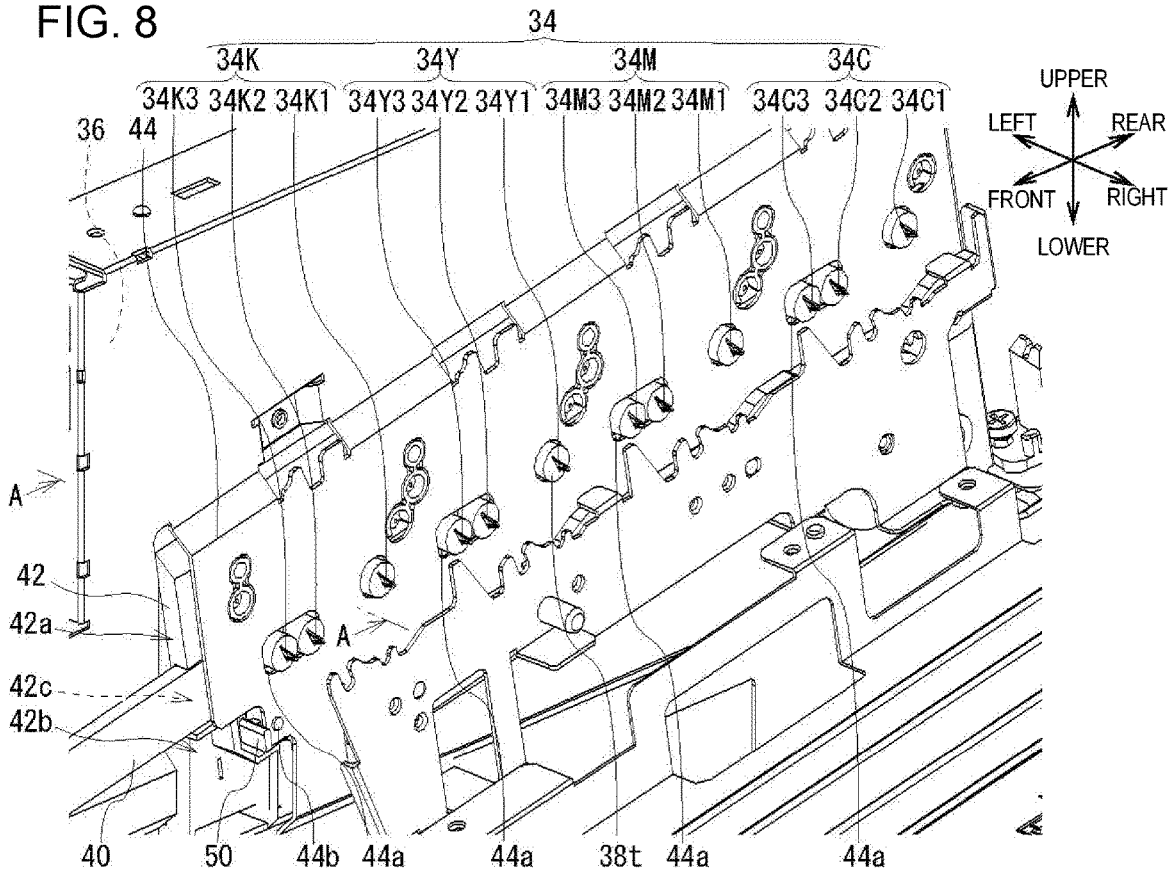
FIG. 8 is a diagram illustrating a perspective view of a configuration in which a sheet metal frame, the slider and a contact point holder are arranged.
Figure 9:
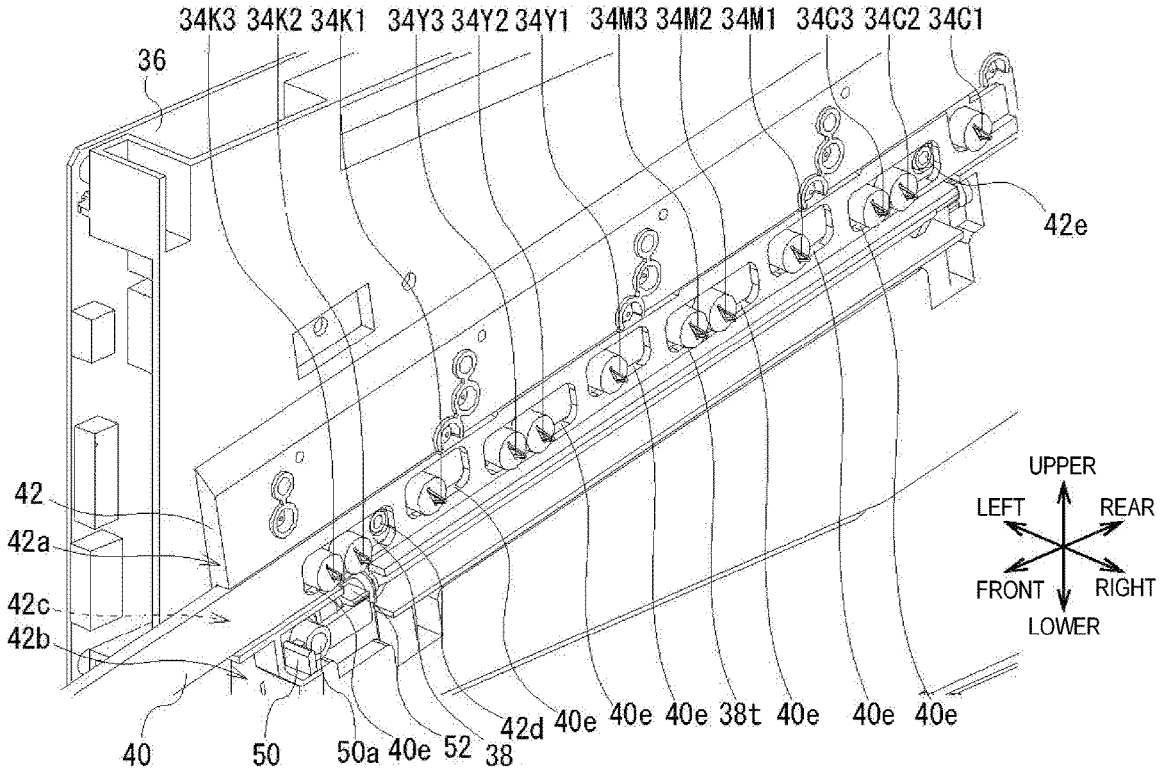
FIG. 9 is a diagram illustrating a perspective view of a configuration in which the slider and the contact point holder are arranged with the sheet metal frame detached.

As illustrated in FIGS. 8 and 9, a power supply board 36, which is a board extending in the front-rear and up-down directions, is provided to an inner side surface of a left side plate of the printer housing 2.

While the basket 30 is located in the image forming position, second contact parts 34K1, 34K2, 34K3 of the main body project rightward from a right side surface of the power supply board 36, and face the first contact parts 32K1, 32K2, 32K3. The second contact parts 34K1, 34K2, 34K3 are metal-made contact parts arranged in this order from the rear to the front in a line in the front-rear direction. The second contact part 34K1 electrically and physically contacts the first contact part 32K1, and is used to apply the voltage to the charge roller in the image forming unit 18K. The second contact part 34K2 electrically and physically contacts the first contact part 32K2, and is used to apply the voltage to the development roller in the image forming unit 18K. The second contact part 34K3 electrically and physically contacts the first contact part 32K3, and is used to apply the voltage to the toner supply roller in the image forming unit 18K.

In addition, like the second contact parts 34K1, 34K2, 34K3, second contact parts 34C1, 34C2, 34C3 project rightward from the right side surface of the power supply board 36 and face the first contact parts 32C1, 32C2, 32C3, while the basket 30 is located in the image forming position. Furthermore, like the second contact parts 34K1, 34K2, 34K3, second contact parts 34M1, 34M2, 34M3 project rightward from the right side surface of the power supply board 36 and face the first contact parts 32M1, 32M2, 32M3, while the basket 30 is located in the image forming position. Moreover, like the second contact parts 34K1, 34K2, 34K3, second contact parts 34Y1, 34Y2, 34Y3 project rightward from the right side surface of the power supply board 36 and face the first contact parts 32Y1, 32Y2, 32Y3, while the basket 30 is located in the image forming position.

The second contact parts 34K1, 34K2, 34K3 are hereinafter generically referred to as "second contact parts 34K" as well. The second contact parts 34C1, 34C2, 34C3 are hereinafter generically referred to as "second contact parts 34C" as well. The second contact parts 34M1, 34M2, 34M3 are hereinafter generically referred to as "second contact parts 34M" as well. The second contact parts 34Y1, 34Y2, 34Y3 are hereinafter generically referred to as "second contact parts 34Y" as well. Moreover, the second contact parts 34K, 34C, 34M, 34Y are hereinafter generically referred to as "second contact parts 34" as well.

As discussed above, the multiple second contact parts 34 project rightward from the right side surface of the power supply board 36. The second contact parts 34 are protected by being inserted in their corresponding cylinder-shaped cylindrical parts 38*t* in a contact point holder 38, which is discussed later.

[1-7. Configuration of Contact Point Frame]

A contact point frame 42 is provided to the right side of the power supply board 36. The contact point frame 42 includes a contact point frame upper part 42*a*, a contact point frame lower part 42*b*, and a groove part 42*c*. The groove part 42*c* is a groove extending in the front-rear direction, and fits over the contact point holder 38 in a way that makes the contact point holder 38 movable in the left-right direction inside the groove part 42*c*, and a slider 40 in a way that makes the slider 40 movable in the front-rear direction inside the groove part 42*c*. The contact point frame upper part 42*a* is a plate-shaped member formed over the groove part 42*c*, and extending in the front-rear direction. The contact point frame lower part 42*b* is a plate-shaped member: formed under the groove part 42*c*; facing the contact point frame upper part 42*a* in the up-down direction; and extending in the front-rear direction. The contact point frame 42 includes: a cylindrical post 42*d* (FIG. 9) fitting in a hole 38*e* (FIG. 10) in the contact point holder 38, and projecting rightward from a front end portion of the contact point frame 42; and a cylindrical post 42*e* (FIG. 9) fitting in a hole 38*f* (FIG. 10) in the contact point holder 38, and projecting rightward from a rear end portion of the contact point frame 42.

[1-8. Configuration of Slider]

Figure 10:
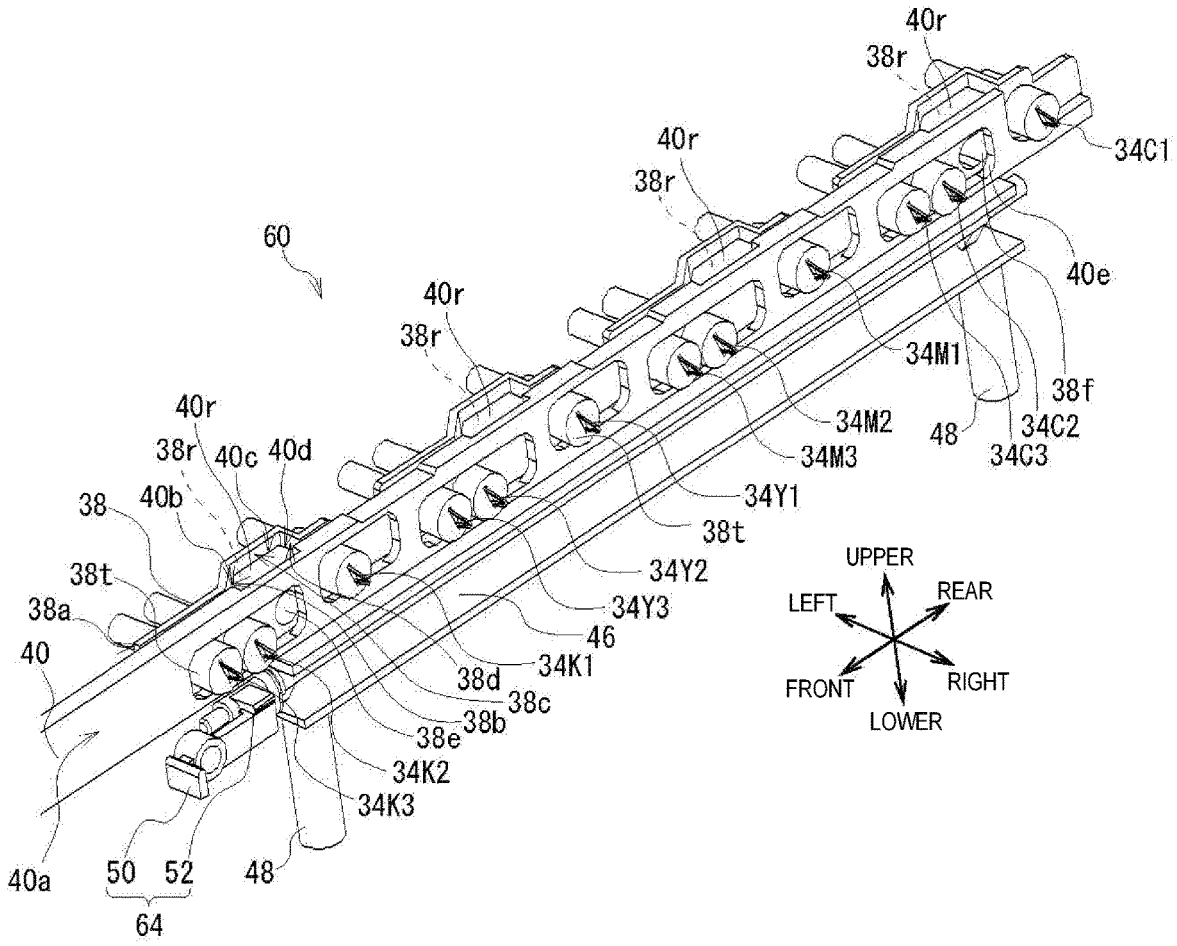
FIG. 10 is a diagram illustrating another perspective view of the configuration in which the slider and the contact point holder are arranged.
Figure 11:
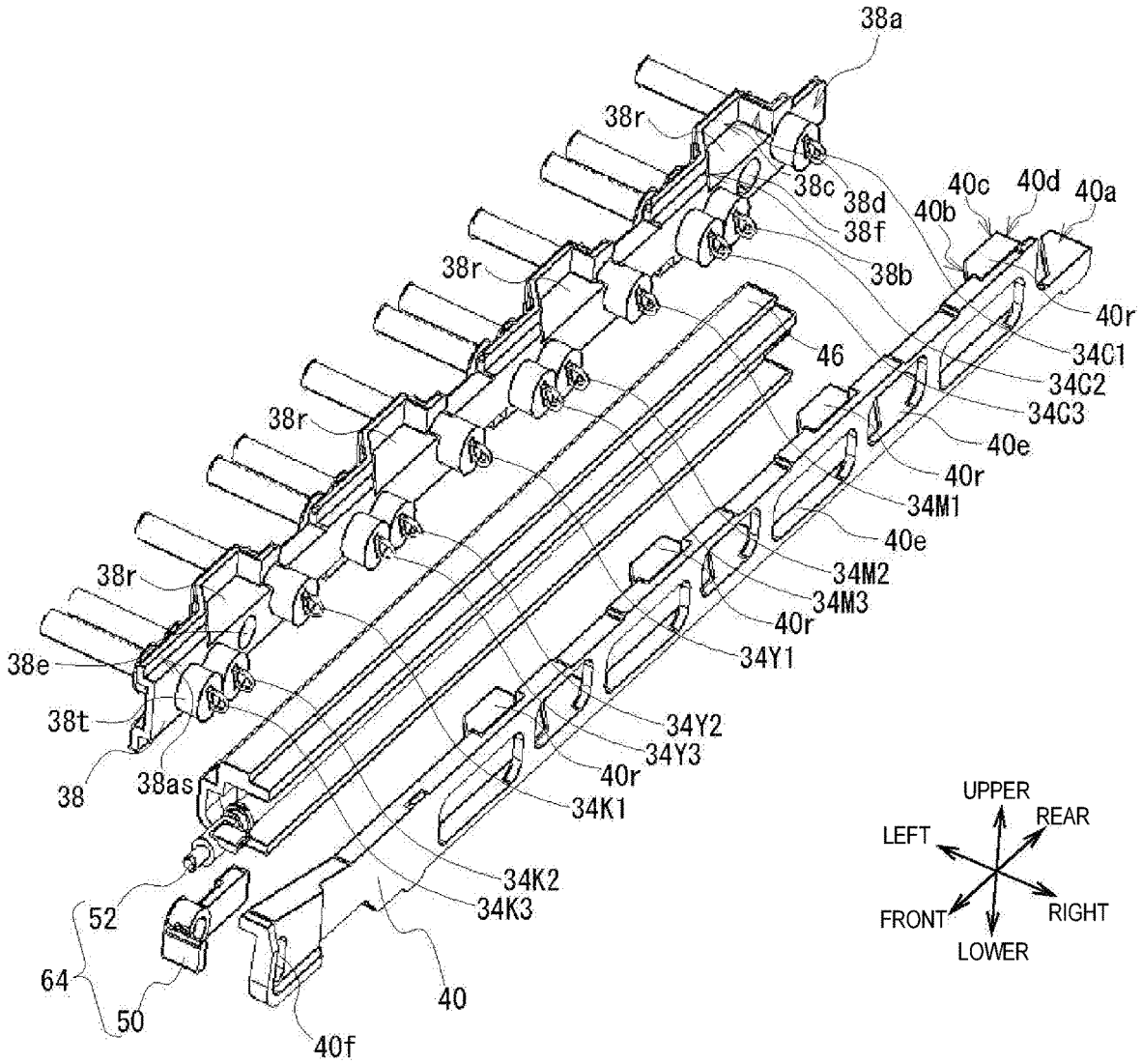
FIG. 11 is a diagram illustrating a perspective view of a configuration in which the slider, the contact point holder and a stopper are arranged.

The slider 40 is a plate-shaped member extending in the front-rear direction, and configured to be capable of reciprocating inside the groove part 42*c* of the contact point frame 42 in the front-rear direction while sliding inside the groove part 42*c* thereof. As illustrated in FIGS. 10 and 11, the slider 40 includes, mainly, a base part 40*a* and four slider ribs 40*r*. The base part 40*a* is a plate-shaped member extending in the front-rear direction.

Figure 12A:
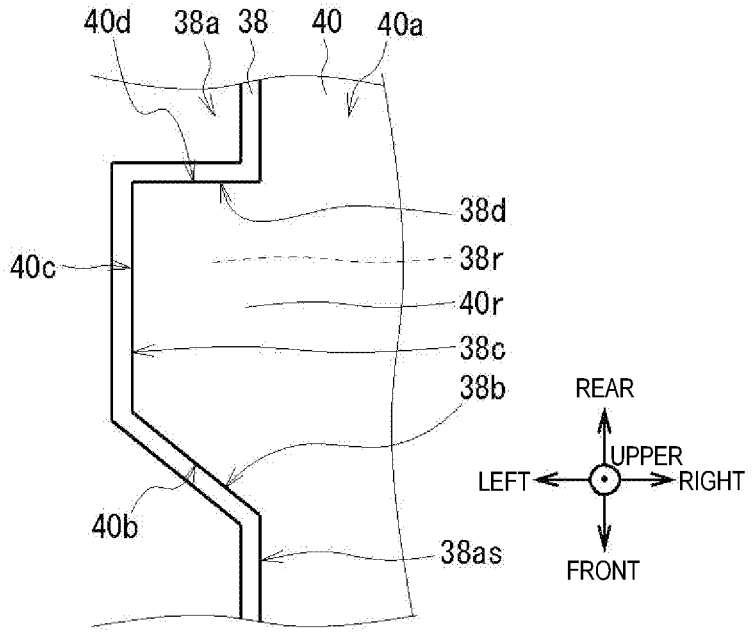
FIGS. 12A and 12B are diagrams illustrating magnified plan views illustrated a configuration in which a slider rib and a rib recessed part are arranged.
Figure 12B:
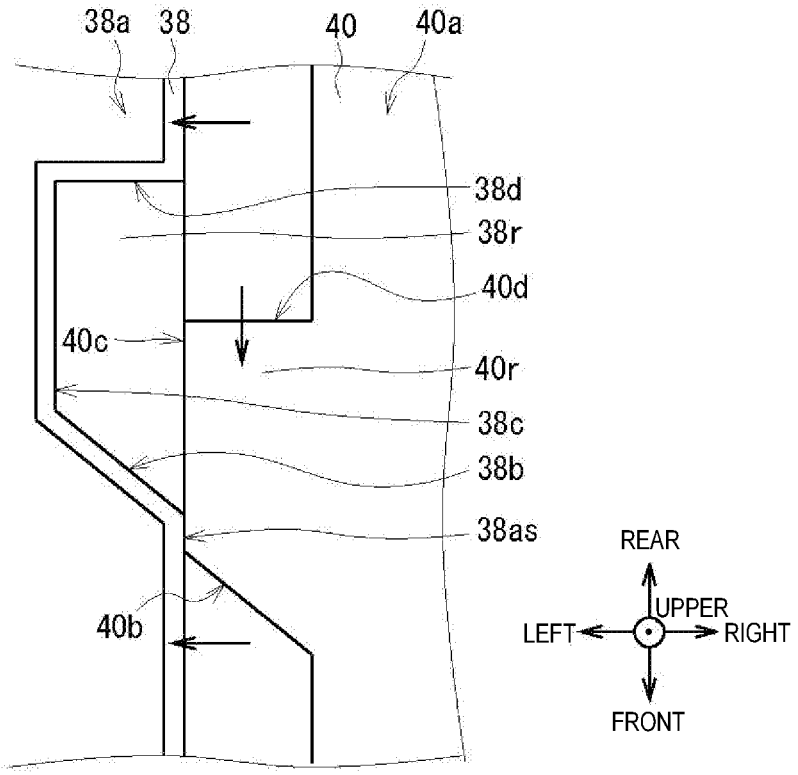

The slider ribs 40*r* as ribs are parts shaped like a trapezoid in a plan view, and projecting leftward from the base part 40*a* to the contact point holder 38. As illustrated in FIGS. 11, 12A and 12B, each slider rib 40*r* is formed from a rib inclined surface 40*b*, a rib surface 40*c* and a rib orthogonal surface 40*d*. The rib inclined surface 40*b* is a flat surface which is inclined leftward from the front-rear direction as the base part 40*a* becomes closer to the rear. While in a later-described contact point exposed state (FIG. 12A), the rib inclined surface 40*b* faces and contacts a recessed part inclined surface 38*b* of the contact point holder 38. When the slider 40 moves frontward and shifts from the contact point exposed state (FIG. 12A) to a contact point withdrawn state (FIG. 12B), the rib inclined surface 40*b* presses the recessed part inclined surface 38*b* of the contact point holder 38 leftward. The rib surface 40*c* is a flat surface extending in the front-rear direction from a rear end portion of the rib inclined surface 40*b* to the rear. While in the contact point exposed state (FIG. 12A), the rib surface 40*c* faces and contacts a recessed part surface 38*c* of the contact point holder 38. When the slider 40 moves frontward and shifts from the contact point exposed state (FIG. 12A) to the contact point withdrawn state (FIG. 12B), the rib surface 40*c* stops at a position where the rib surface 40*c* comes into contact with a base part surface 38*as*, which is an upper right flat surface of the base part 38*a* of the contact point holder 38. The rib orthogonal surface 40*d* is a flat surface extending from a rear end portion of the rib surface 40*c* to the base part 40*a* in the left-right direction which is orthogonal to the front-rear direction. While in the contact point exposed state (FIG. 12A), the rib orthogonal surface 40*d* faces and contacts a recessed part orthogonal surface 38*d* of the contact point holder 38.

As illustrated in FIGS. 9, 10, 11, slider opening part parts 40*e* are made in portions of the base part 40*a* of the slider 40 which face the second contact parts 34 of the main body. While the basket 30 is in the image forming position, the second contact parts 34 penetrate the slider 40 and the sheet metal frame 44 (FIG. 8) through the slider opening parts 40*e*, and are exposed to the right of the slider 40 and the sheet metal frame 44.

Figure 7:
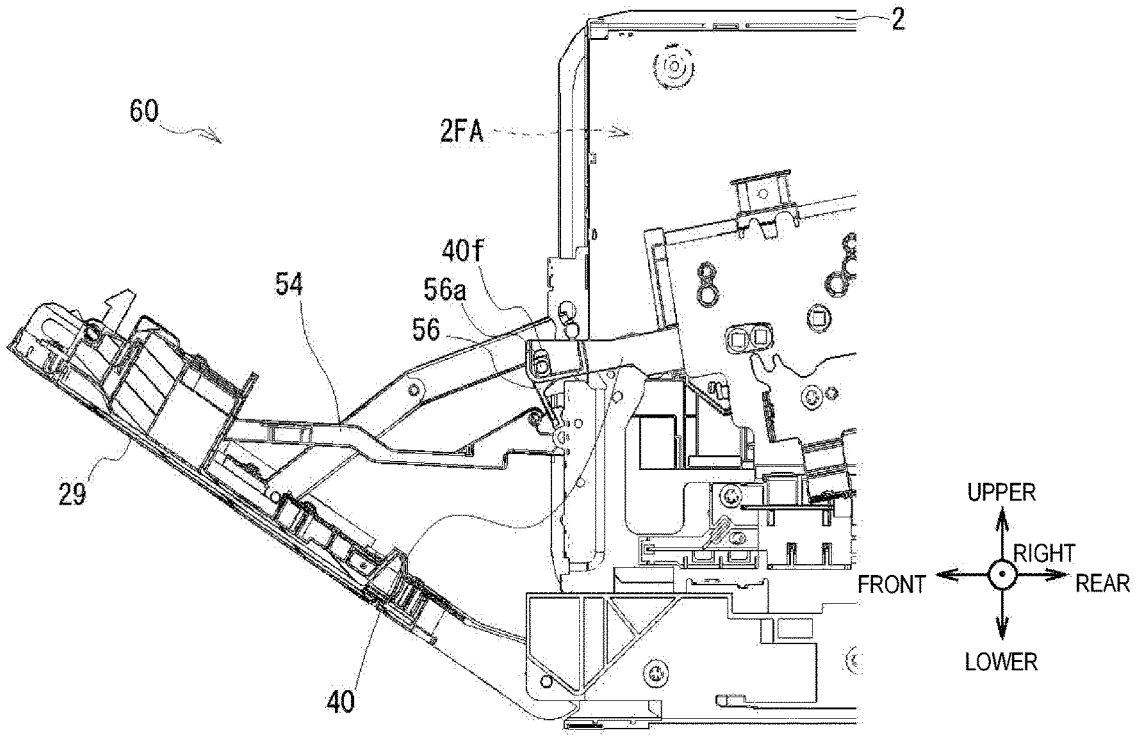
FIG. 7 is a diagram illustrating a right side view of a configuration (2) in which the front cover and the slider are arranged while the front cover is opened.

A slider hole part 40*f* (FIG. 11) is made in a distal end of the slider 40. As illustrated in FIG. 7, a cylindrical release lever protrusion 56*a* of a release lever 56 is slidably fitted in the slider hole part 40*f*. The release lever 56 is attached to a front portion of the printer housing 2 in a way that enables the release lever 56 to turn around the printer housing 2. A front cover lever 54 engages with the release lever 56. A rear end portion of the front cover lever 54 is attached to the front portion of the printer housing 2 in a way that enables the front cover lever 54 to turn around the printer housing 2, while a front end portion of the front cover lever 54 is attached to the front cover 29.

Figure 5:
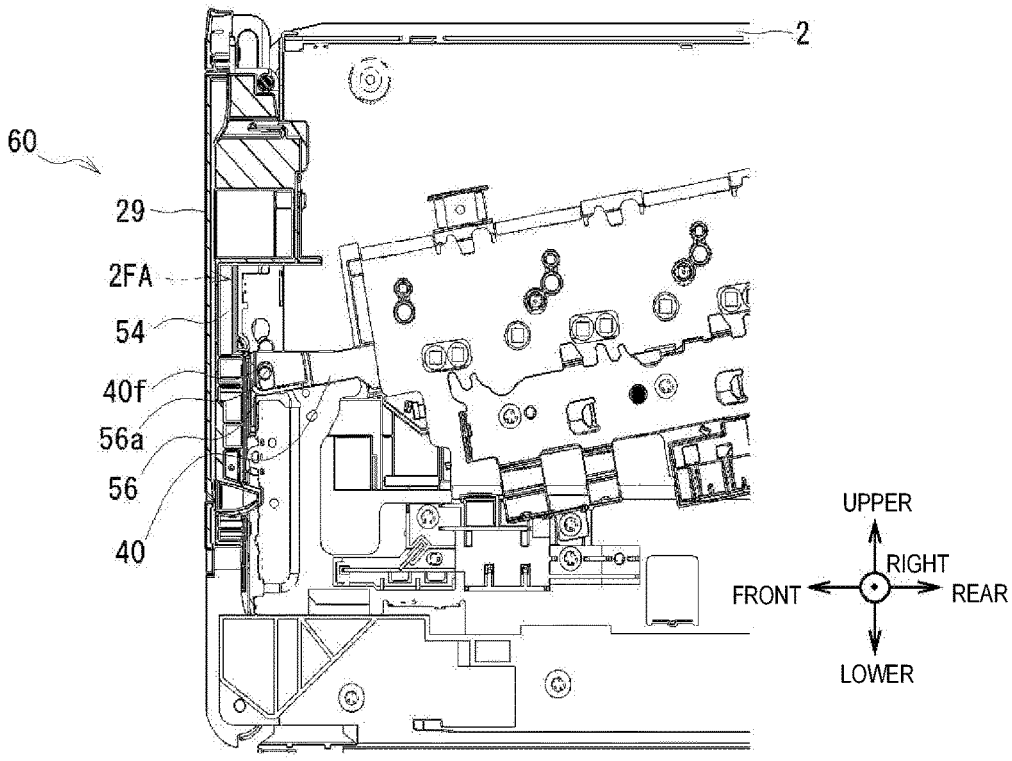
FIG. 5 is a diagram illustrating a right side view of a configuration in which the front cover and a slider are arranged while the front cover is closed.
Figure 6:
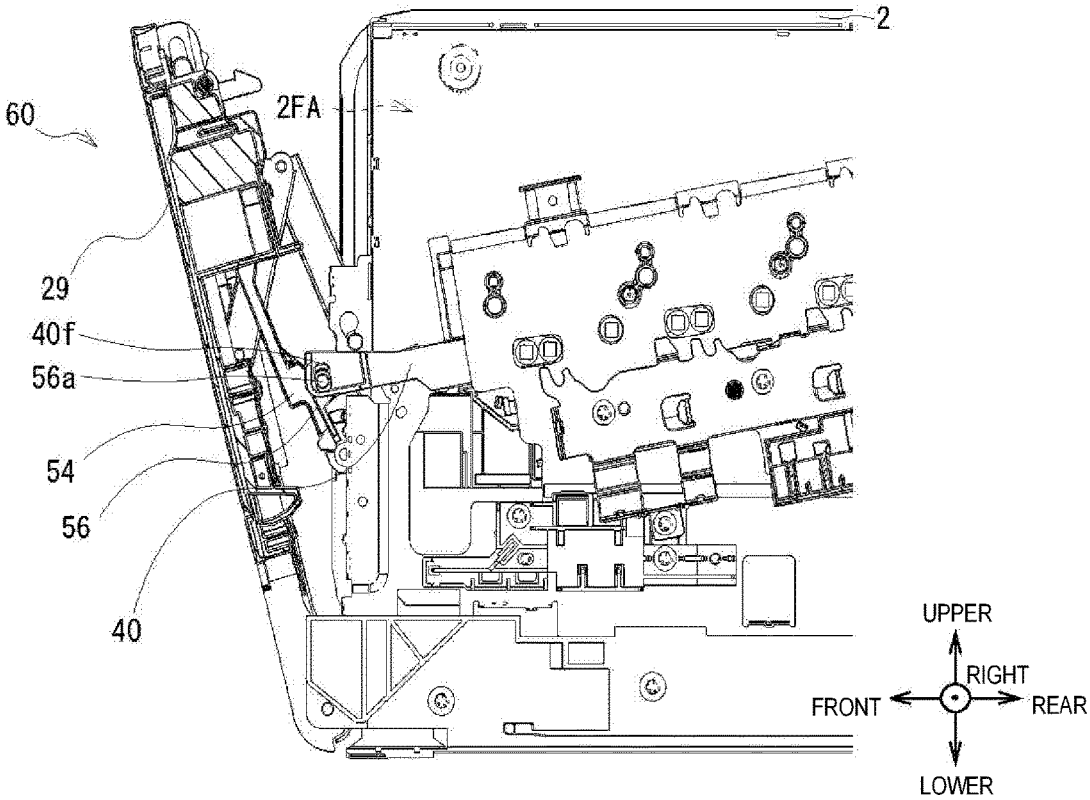
FIG. 6 is a diagram illustrating a right side view of a configuration (1) in which the front cover and the slider are arranged while the front cover is opened.

When an upper end portion of the front cover 29 is pulled frontward to open the front cover 29 from the front cover closed state illustrated in FIG. 5, the above-discussed configuration turns the front cover lever 54 and the release lever 56 in the counterclockwise direction in FIG. 5, and draws the slider 40 frontward as illustrated in FIG. 6. In FIG. 6, the front cover 29 turns at 15 degrees from the front cover closed state, and at that time, the contact point holder 38 completes its movement from the contact point exposed state to the contact point withdrawn state, which are discussed later. In addition, when the front cover 29 is further opened, only the front cover lever 54 further turns in the counterclockwise direction in FIG. 6, and comes into the front cover opened state. During the shift from the state illustrated in FIG. 6 to the state illustrated in FIG. 7, the slider 40 does not move forward.

As discussed above, the slider 40 engages with the front cover 29 with the assistance of the front cover lever 54 and the release lever 56. Thus, once the front cover 29 is opened, the slider 40 is drawn frontward according to the turn of the front cover 29.

[1-9. Configuration of Contact Point Holder]

The contact point holder 38 is arranged inside the groove part 42*c* of the contact point frame 42, and on the left side of the slider 40. The contact point holder 38 is a member formed integrally from the right side of the image forming unit 18K to the right side of the image forming unit 18C, and extending in the front-rear direction. As illustrated in FIGS. 10 and 11, the contact point holder 38 includes: the hole 38*e* into which to insert the post 42*d* of the contact point frame 42, made in a front end portion of the contact point holder 38; and the hole 38*f* into which to insert the post 42*e* of the contact point frame 42, made in a rear end portion of the contact point holder 38. In addition, the posts 42*d*, 42*e* of the contact point frame 42 are fitted in the holes 38*e*, 38*f* of the contact point holder 38 in a way that makes the posts 42*d*, 42*e* slidable in the left-right direction. To this end, the contact point holder 38 is provided in a way that makes the contact point holder 38 movable in the left-right direction orthogonal to the front-rear direction in which the slider 40 moves. Specifically, the contact point holder 38 is configured to be capable of moving the second contact parts 34 of the main body in the rightward direction, that is to say, an approach direction in which the second contact parts 34 of the main body are brought close to the first contact parts 32 of the image forming section; and in the leftward direction, that is to say, a withdrawal direction in which the second contact parts 34 of the main body are isolated and withdrawn from the first contact parts 32 of the image forming section.

As illustrated in FIG. 11, the contact point holder 38 includes, mainly, the base part 38*a*, the twelve cylindrical parts 38*t* and four rib recessed parts 38*r*. The base part 38*a* is a plate-shaped member extending in the front-rear direction.

Each cylindrical part 38*t* is formed in a cylindrical shape, and the corresponding second contact part 34 is protected by being inserted in the cylindrical part 38*t*. Specifically, as shown by the internal structure of the cylindrical part 38*t* in the FIGS. 13A and 13B, the second contact part 34 is formed from a single wound metal-made rod. A spring part 34*s* serving as a compression coil spring is formed in the left side portion of the second contact part 34, while a triangular contact point part 34*c* is formed in the right distal end portion of the second contact part 34. The second contact point part 34*c* projects rightward from a slit-shaped hole part 38*ta* formed in the right end surface of the cylindrical part 38*t*. A wire 36*w* extending from the power supply board 36 is connected to the left side of the spring part 34*s*, and an electric power is supplied from the power supply board 36 to the second contact part 34 via the wire 36*w*. Upper and lower edge parts 38*te* of the hole part 38*ta* of the cylindrical part 38*t* contact upper and lower end portions of the second contact point part 34*c*.

While in the front cover closed state, as illustrated in FIGS. 9, 10, 13A, 14 and 16, the above-discussed configuration puts each second contact part 34 and the corresponding cylindrical part 38*t* of the contact point holder 38 in the contact point exposed state in which due to a biasing force of the spring part 34*s* of the second contact part 34, the second contact part 34 and the cylindrical part 38*t* project rightward, or toward the inner side of the apparatus, beyond a right wall surface of the sheet metal frame 44; pass through the basket opening parts 30A (FIGS. 3 and 14); and become able to contact the corresponding first contact part 32.

Figure 13A:
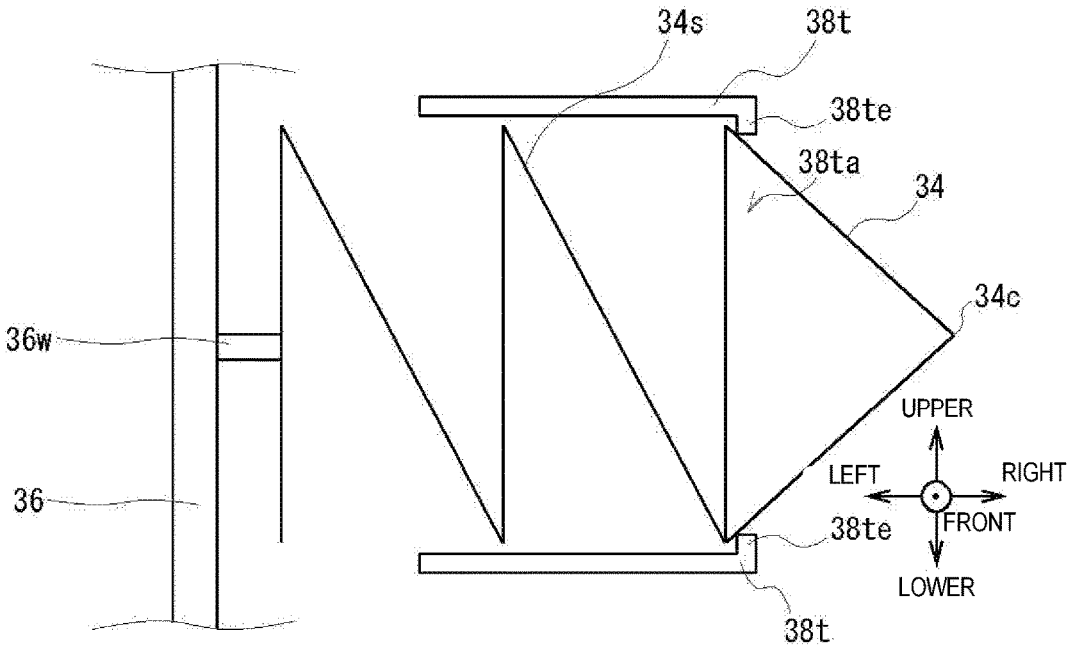
FIGS. 13A and 13B are diagrams illustrating front views of a configuration in which an apparatus body-side contact part and a cylindrical part are arranged.
Figure 13B:
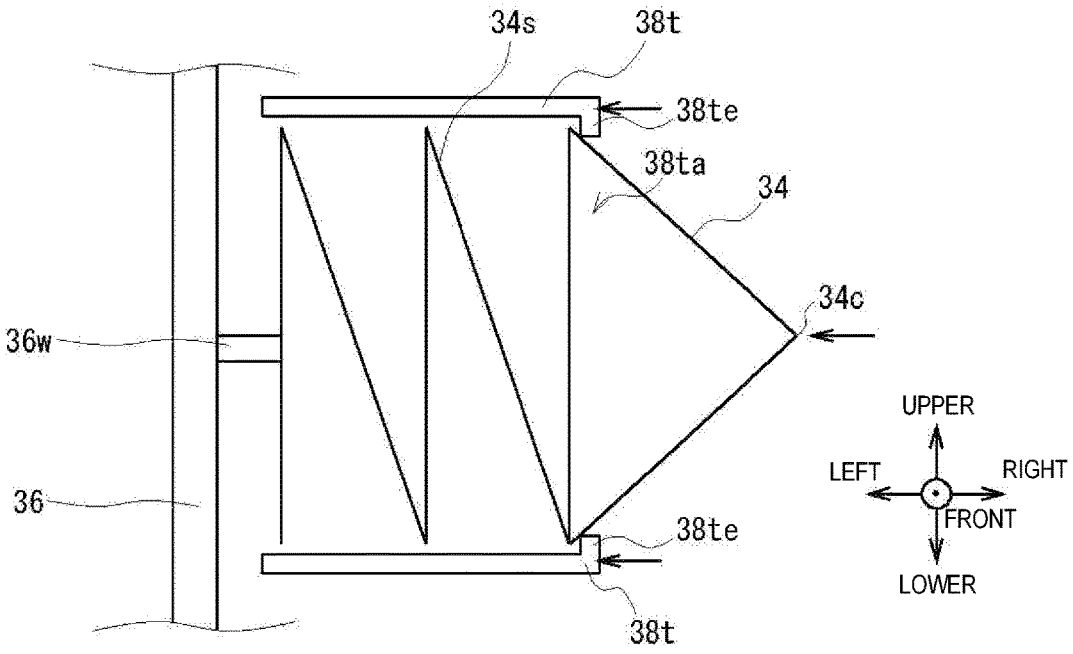
Figure 15:
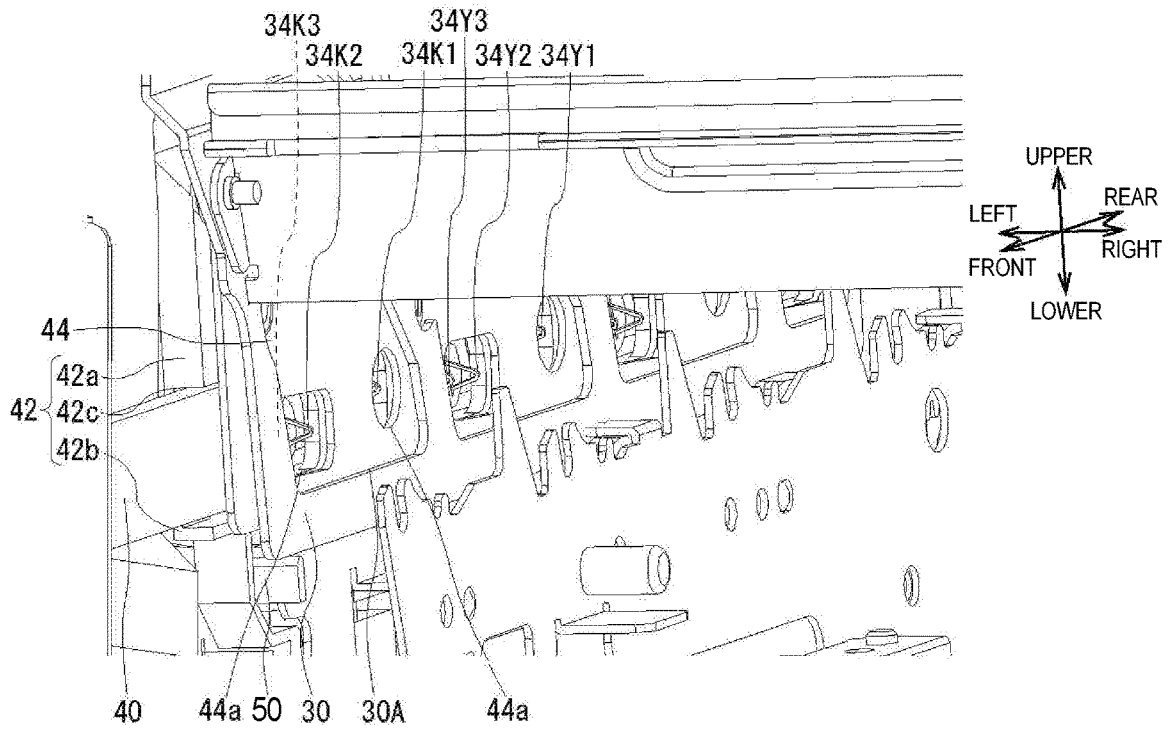
FIG. 15 is a diagram illustrating a perspective view of a configuration in which the slider, the contact point holder and the apparatus body-sides contact parts are arranged while in a contact point withdrawn state.
Figure 17:
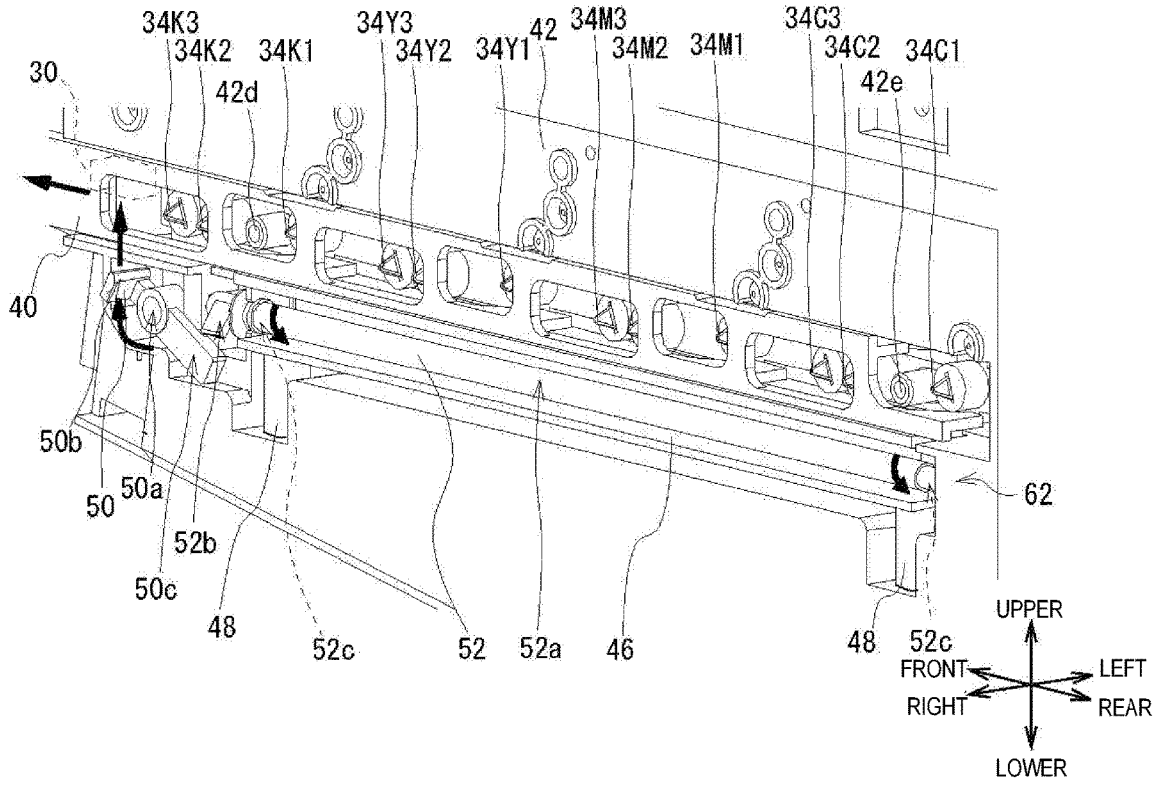
FIG. 17 is a diagram illustrating a perspective view of a configuration in which the first lever, the second lever and the stopper are arranged while the in a holder movement restricted state.

On the other hand, while in the front cover opened state, as illustrated in FIGS. 13B, 15 and 17, the above-discussed configuration puts each second contact part 34 and the corresponding cylindrical part 38*t* of the contact point holder 38 in the contact point withdrawn state in which: along with the forward movement of the slider 40, the cylindrical part 38*t* moves leftward to compress the spring part 34*s* (FIG. 13B), although later discussed in detail; and the second contact part 34 and the cylindrical part 38*t* withdraw leftward, or toward the outer side of the apparatus, from inside the right wall surface of the sheet metal frame 44, and become unable to contact the first contact part 32.

As illustrated in FIGS. 10, 11, 12A and 12B, each rib recessed part 38*r* is a part including a space formed on an upper portion of the base part 38*a*, as well as shaped like a trapezoid and recessed leftward in its plan view. While in the contact point exposed state, a corresponding slider rib 40*r* of the slider 40 fits in the rib recessed part 38*r*. The rib recessed part 38*r* is formed from the recessed part inclined surface 38*b*, the recessed part surface 38*c* and the recessed part orthogonal surface 38*d*. The recessed part inclined surface 38*b* is a flat surface which is inclined further leftward from the front-rear direction as the base part 38*a* becomes closer the rear. While in the contact point exposed state (FIG. 12A), the recessed part inclined surface 38*b* faces and contacts a corresponding rib inclined surface 40*b* of the slider 40. When the slider 40 moves frontward and shifts from the contact point exposed state (FIG. 12A) to the contact point withdrawn state (FIG. 12B), the recessed part inclined surface 38*b* is pushed leftward by the rib inclined surface 40*b* of the slider 40. The recessed part surface 38*c* is a flat surface extending in the front-rear direction from a rear end portion of the recessed part inclined surface 38*b* to the rear. While in the contact point exposed state (FIG. 12A), the recessed part surface 38*c* faces and contacts the rib surface 40*c* of the slider 40. When the slider 40 moves frontward and shifts from the contact point exposed state (FIG. 12A) to the contact point withdrawn state (FIG. 12B), the recessed part surface 38*c* separates leftward from the rib surface 40*c* of the slider 40. The recessed part orthogonal surface 38*d* is a flat surface extending from a rear end portion of the recessed part surface 38*c* to the base part 38*a* in the left-right direction which is orthogonal to the front-rear direction. While in the contact point exposed state (FIG. 12A), the recessed part orthogonal surface 38*d* faces and contacts the rib orthogonal surface 40*d* of the slider 40.

[1-10. Engagement Between Slider and Contact Point Holder]

While in the front cover closed state, as illustrated in FIG. 12A, the above-discussed configuration causes the slider 40 to put the rib inclined surface 40*b* in contact with the recessed part inclined surface 38*b* of the contact point holder 38, to put the rib surface 40*c* in contact with the recessed part surface 38*c* of the contact point holder 38, to put the rib orthogonal surface 40*d* in contact with the recessed part orthogonal surface 38*d* of the contact point holder 38, and to fit the slider rib 40*r* in the rib recessed part 38*r* of the contact point holder 38. Thus, each second contact part 34 is in the contact point exposed state, as illustrated in FIGS. 13A and 14.

When the front cover 29 is opened from the front cover closed state (the contact point exposed state) and the slider 40 moves frontward, each rib inclined surface 40*b* of the slider 40 pushes and moves the corresponding recessed part inclined surface 38*b* of the contact point holder 38 in the withdrawal direction (in the leftward direction). When the slider 40 further moves frontward, the slider 40 stops at a position where the rib surface 40*c* of the slider 40 comes into contact with the base part surface 38*as* of the contact point holder 38, as illustrated in FIG. 12B. Thus, each second contact part 34 is put in the contact point withdrawn state, as illustrated in FIGS. 13B and 15.

[1-11. Configuration of Sheet Metal Frame]

Figure 14:
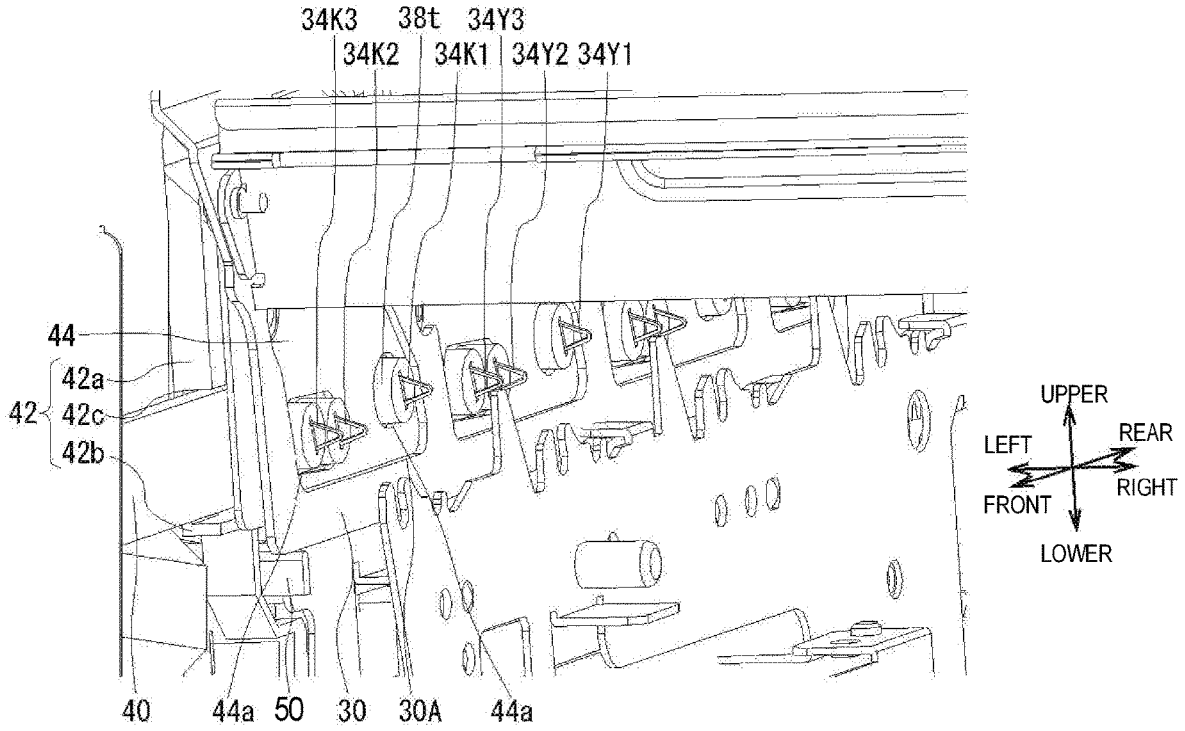
FIG. 14 is a diagram illustrating a perspective view of a configuration in which the slider, the contact point holder and the apparatus body-sides contact parts are arranged while in a contact point exposed state.

As illustrated in FIGS. 8, 14 and 15, the sheet metal frame 44 is provided on the right side of the contact point frame 42 and the slider 40. The sheet metal frame 44 is a sheet metal extending in the front-rear and up-down directions, and covering the contact point frame 42 and the slider 40. Sheet metal frame opening parts 44*a* are made in portions of the sheet metal frame 44 which face the second contact parts 34 while the basket 30 is in the image forming position. While the basket 30 is in the image forming position, the second contact parts 34 penetrate the sheet metal frame 44 through the sheet metal frame opening parts 44*a*, and are exposed to the right of the sheet metal frame 44.

[1-12. Configuration of Stopper]

As illustrated in FIGS. 10, 11, 16, 17, 18 and 19, a stopper 46 is a plate-shaped member having a cross section shaped like the capital letter U turned by 90 degrees, extending in the front-rear direction. The stopper 46 houses a second lever 52. The stopper 46 is arranged under the contact point holder 38, and is configured to be capable of reciprocating in the up-down direction. Furthermore, the stopper 46 is biased upward by springs 48. While in a holder movement allowed state illustrated in FIGS. 16 and 18, the stopper 46 contacts stopper movement restricting parts 52*c* of the second lever 52, and an upward movement of the stopper 46 is accordingly restricted by this contact. While in the holder movement allowed state, the stopper 46 descends lower than the interstice between the contact point holder 38 and the sheet metal frame 44, and allows the contact point holder 38 to move in an exposure direction (in the rightward direction) and project rightward beyond the sheet metal frame 44. Thereby, the stopper 46 enables a return from the contact point withdrawn state to the contact point exposed state.

Figure 19:
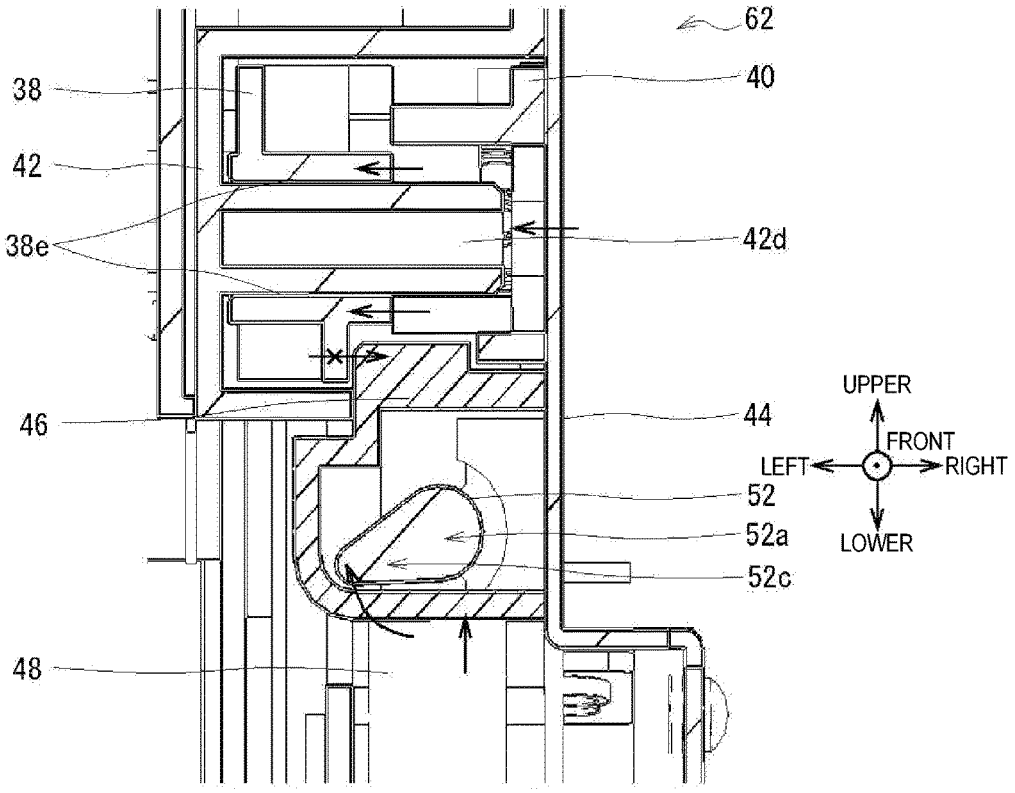
FIG. 19 is a perspective view of a configuration in which the second lever, the stopper and the contact point holder are arranged while in the holder movement restricted state.

While in a holder movement restricted state illustrated in FIGS. 17 and 19, the stopper movement restricting parts 52*c* of the second lever 52 withdraw from the movement track of the stopper 46, and the stopper 46 is pushed up higher by the biasing force of the springs 48 than while in the holder movement allowed state. Accordingly, the upper end portion of the stopper 46 rises to the interstice between the contact point holder 38 and the sheet metal frame 44. While in the holder movement restricted state, the stopper 46 restricts the movement of the contact point holder 38 in the exposure direction in order for the contact point holder 38 not to return to the contact point exposed state and project rightward beyond the sheet metal frame 44, and thereby holds the contact point holder 38 in the contact point withdrawn state.

The springs 48 are compression coil springs provided, respectively, under the front and rear end portions of the stopper 46. The springs 48 bias and push up the stopper 46, and bias the second lever 52 in the counterclockwise direction in a rear view.

[1-13. Configuration of First Lever]

A first lever 50 is provided under portions of the slider 40 and the contact point holder 38 which correspond to the image forming unit 18K, and on a movement track along which the basket 30 moves between the image forming position and the displaced position. The first lever 50 includes a basket contact part 50*b*, a second lever contact part 50*c* and a fulcrum 50*a*, and can turn on the fulcrum 50*a*. The fulcrum 50*a* fits in a rotation shaft 44*b* provided to the sheet metal frame 44 (FIG. 8). The first lever 50 is biased by a biasing member (not illustrated) in a way that enables the first lever 50 to turn on the fulcrum 50*a* in the clockwise direction in FIG. 16. The basket contact part 50*b* is a member extending from the fulcrum 50*a* to the front, and shaped like the capital letter L in its plan view. The second lever contact part 50*c* is a rod-shaped member facing the basket contact part 50*b* with the fulcrum 50*a* interposed in between, and extending from the fulcrum 50*a* to the rear. Incidentally, in FIGS. 16 and 17, a broken line schematically shows a part of the basket 30 which contacts the first lever 50.

Figure 16:
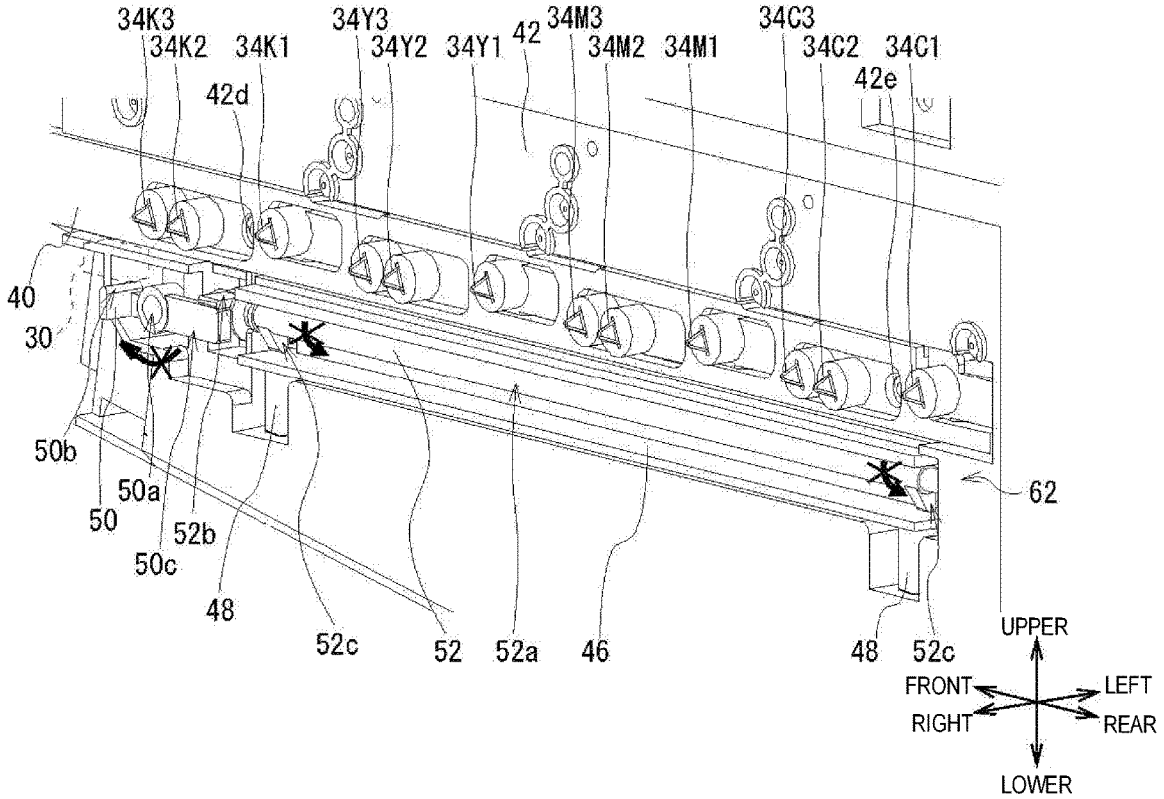
FIG. 16 is a diagram illustrating a perspective view of a configuration in which a first lever, a second lever and the stopper are arranged while in a holder movement allowed state.

While the basket 30 is in the image forming position, the basket 30 pushes down the basket contact part 50*b* of the first lever 50 as illustrated in FIG. 16, and thereby restricts the clockwise turn of the first lever 50 in FIG. 16. Thus, while the basket 30 is in the image forming position, the second lever contact part 50*c* contacts the lower side of the first lever contact part 52*b* of the second lever 52 although later described in detail, and the first lever 50 accordingly restricts the counterclockwise turn of the second lever 52 (in an arrowed direction) in its rear view.

Meanwhile, when the top cover 28 shifts from the top cover closed state to the top cover opened state and the basket 30 shifts from the image forming position to the displaced position, the basket 30 does not push down the basket contact part 50*b* as illustrated in FIG. 17, and the clockwise turn of the first lever 50 in FIG. 17 is allowed. While the basket 30 is in the displaced position, the second lever contact part 50*c* of the first lever 50 withdraws downward from the lower side of the first lever contact part 52*b* of the second lever 52, and the first lever 50 allows the counterclockwise turn of the second lever 52 (in an arrowed direction) in its rear view.

[1-14. Configuration of Second Lever]

The second lever 52 is provided behind the first lever 50 in an internal space of the stopper 46. The second lever 52 is formed from a cylindrical part 52*a*, the first lever contact part 52*b* and the stopper movement restricting parts 52*c*, and turns on the cylindrical part 52*a*. The cylindrical part 52*a* is a cylinder-shaped member extending from a right lower side of the image forming unit 18K to a right lower side of the image forming unit 18C. The first lever contact part 52*b* is a plate-shaped member formed on an outer peripheral surface of a front end portion of the cylindrical part 52*a*. The stopper movement restricting parts 52*c* are substantially triangular members: one formed on a portion of the cylindrical part 52*a* which is located behind the first lever contact part 52*b*, and the other formed on a rear end portion of the cylindrical part 52*a*. In addition, the springs 48 bias the second lever 52 in the counterclockwise direction in the rear view.

Figure 18:
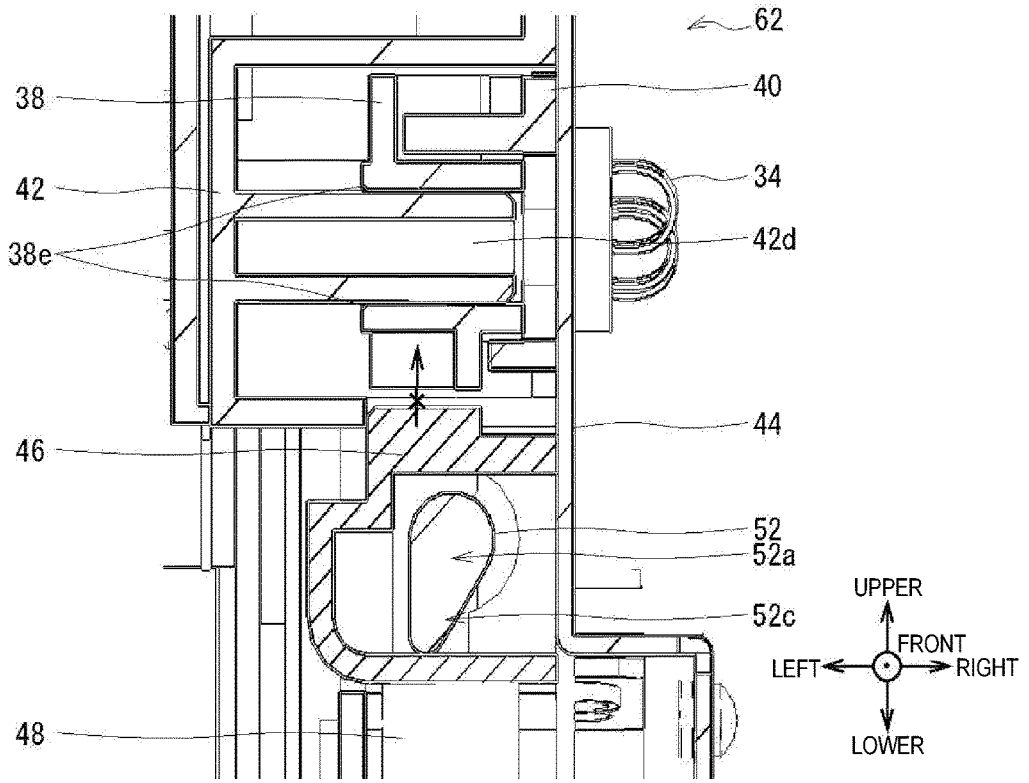
FIG. 18 is a diagram illustrating a cross-sectional view of the configuration taken along the A-A line in FIG. 8, and illustrates a configuration in which the second lever, the stopper and the contact point holder are arranged while in the holder movement allowed state.

While the basket 30 is in the image forming position, as illustrated in FIG. 16, the second lever contact part 50*c* of the first lever 50 restricts the counterclockwise turn of the second lever 52 in the rear view of the second lever 52. While in this state, the stopper movement restricting parts 52*c* are located between the cylindrical part 52*a* and the stopper 46 as illustrated in FIG. 18, and push down the lower side plate of the stopper 46 to restrict an upward movement of the stopper 46.

On the other hand, when the basket 30 shifts from the image forming position to the displaced position, the second lever contact part 50*c* of the first lever 50 withdraws downward from the lower side of the first lever contact part 52*b* of the second lever 52 as illustrated in FIG. 17, and the counterclockwise turn of the second lever 52 in the rear view of the second lever 52 is allowed. While in this state, the stopper movement restricting parts 52*c* withdraw leftward from the interstice between the cylindrical part 52*a* and the stopper 46 as illustrated in FIG. 19, and are in a state of not restricting the upper movement of the stopper 46.

[1-15. Sequence for Replacing Image Forming Units]

Next, descriptions are provided for an example of how the image forming apparatus 1 works when an image forming unit 18 is replaced with a new one. This example is applicable to how the image forming apparatus 1 works when a jam clearing operation for removing a jammed sheet is carried out in a case where a medium jam occurs in which the sheet gets jammed inside the image forming apparatus 1.

To begin with, as illustrated in FIG. 7, the user opens the front cover 29 from the state illustrated in FIG. 5. Thus, the slider 40 is pulled out along with the turn of the front cover 29, since the slider 40 engages with the front cover 29 with the assistance of the front cover lever 54 and the release lever 56 as discussed above. Hence, the slider 40 pushes the contact point holder 38 in the withdrawal direction (FIG. 12B), and thereby shifts the contact point holder 38 from the contact point exposed state (FIGS. 13A and 14) to the contact point withdrawn state (FIGS. 13B and 15).

Thereafter, the user opens the top cover 28 as illustrated in FIG. 4(A), and establishes the two-cover opened state. Since as discussed above, the basket 30 engages with the top cover 28, the basket 30 and the image forming units 18 supported by the basket 30 rise along with the turn of the top cover 28, and shift from the image forming position and the displaced position.

Thus, the first lever 50 is released from being pressed by the basket 30 (FIG. 16), and becomes free from the basket 30 as illustrated in FIG. 17. Hence, the second lever 52 becomes able to turn freely, and the cylindrical part 52*a* of the second lever 52 turns in the arrowed direction. Accordingly, the stopper 46 is pushed up by the springs 48 as illustrated in FIG. 19, and rises to the interstice between the contact point holder 38 and the sheet metal frame 44 to shift from the holder movement allowed state (FIGS. 16 and 18) to the holder movement restricted state (FIGS. 17 and 18). Thereby, the stopper 46 restricts the contact point holder 38 such that the contact point holder 38 remains in the contact point exposed sate instead of returning to the contact point withdrawn state.

Before replacing an image forming unit 18 with a new one, the user pulls out the basket 30 from the displaced position to the pulled-out position as illustrated in FIG. 2. Thereby, the image forming unit 18 becomes detachable from the basket 30, and can be replaced with a different image forming unit 18. At this time, as illustrated in FIG. 15, the contact point holder 38 and the second contact parts 34 are in the contact point withdrawn state in which the contact point holder 38 and the second contact parts 34 withdraw and stay outside the sheet metal frame 44. The image forming apparatus 1, therefore, can pull put the basket 30 and the image forming units 18 without allowing the basket 30 and the image forming units 18 to slide along the second contact parts 34.

After replacing the image forming unit 18 with the different one, the user pushes back the basket 30 from the pulled-out position to the displaced position, and the front cover 29 becomes able to be closed. While the basket 30 is moving, the second contact parts 34 do not slide along the basket 30 or the image forming units 18 either, since the contact point holder 38 and the second contact parts 34 are in the contact point withdrawn state.

[1-16. Closing of Top Cover from Two-Cover Opened State Before Front Cover]

Next, when the top cover 28 is closed from the two-cover opened state before the front cover 29, the basket 30 and the image forming units 18 supported by the basket 30 descend. When the basket 30 pushes the first lever 50 as illustrated in FIG. 16, the second lever 52 turns and pushes down the stopper 46 from a state illustrated in FIG. 19 to a state illustrated in FIG. 18. Hence, the stopper 46 shifts from the holder movement restricted state to the holder movement allowed state. Meanwhile, the slider 40 engaging with the front cover 29 is pulled out, and the rib surfaces 40*c* of the slider 40 are held at positions where the rib surfaces 40*c* contact the base part surfaces 38*as* (FIG. 12B) of the contact point holder 38. Since like this, the contact point holder 38 and the second contact parts 34 are in the contact point withdrawn state, the second contact parts 34 do not slide along the basket 30 and the image forming units 18.

Eventually, when the front cover 29 is closed, the slider 40 is pushed rearward. Thereby, the rib surfaces 40*c* of the slider 40 go away from the base part surfaces 38*as* (FIG. 12B) of the contact point holder 38, and the slider 40 returns to the state in which the slider ribs 40*r* fit in the rib recessed parts 38*r* (FIG. 12A). Thus, the contact point holder 38 and the second contact parts 34 shift from the contact point withdrawn state to the contact point exposed state. Accordingly, the second contact parts 34 of the main body project rightward beyond the sheet metal frame 44, and come into contact with the first contact parts 32 of the image forming units 18. Hence, the image forming apparatus 1 becomes able to perform printing.

[1-17. Closing of Front Cover from Two-Cover Opened State Before Top Cover]

Next, descriptions are provided for how the image forming apparatus works in a case where the front cover 29 is closed from the two-cover opened state before the top cover 28 despite the expected sequence in which the top cover 28 is closed before the front cover 29. When the front cover 29 is closed, the slider 40 is pushed rearward, and the rib surfaces 40*c* of the slider 40 go away from the base part surfaces 38*as* (FIG. 12B) of the contact point holder 38. At this time, the basket 30 does not press the basket contact part 50*b* of the first lever 50 from above. The stopper 46 is therefore located between the contact point holder 38 and the sheet metal frame 44 as illustrated in FIG. 19, and restricts the contact point holder 38 such that the contact point holder 38 remains in the contact point withdrawn sate instead of returning to the contact point exposed state. Thereafter, when the top cover 28 is closed, the basket 30 and the image forming units 18 supported by the basket 30 descend.

The basket 30 has a structure in which the basket 30 presses the first lever 50 when the edges of the lower ends of the basket opening parts 30A (FIG. 15) of the basket 30 pass the second contact parts 34 of the main body from above to under the second contact parts 34 of the main body. In addition, the stopper 46 shifts from the holder movement restricted state to the holder movement allowed state at the position where the second contact parts 34 of the main body contact the first contact parts 32 of the image forming section. Thus, the image forming apparatus 1 can prevent the second contact parts 34 from sliding along the basket 30 and the image forming units 18, and can prevent abrasion of the second contact parts 34, adhesion of abrasion powder, deformation of the contact parts, and the like which are caused by the sliding between components other than the first contact parts 32 of the image forming section and the second contact parts 34 of the main body.

[1-18. Working and Effects]

Because of the above-discussed configurations, when the front cover 29 is opened from the front cover closed state, the image forming apparatus 1 pulls out the slider 40 toward the front along with the turn of the front cover 29, and causes the slider 40 to push the contact point holder 38 in the withdrawal direction to shift the contact point holder 38 from the contact point exposed state to the contact point withdrawn state. Thus, the image forming apparatus 1 can withdraw the second contact parts 34 of the main body from the movement track of the image forming units 18 and the basket 30. When the basket 30 shifts between the displaced position and the image forming position, therefore, the image forming apparatus 1 can prevent the image forming units 18 and the basket 30 from abrading the second contact parts 34 of the main body.

In addition, when the top cover 28 is opened from the top cover closed state, the image forming apparatus 1 turns the first lever 50 and the second lever 52 along with the turn of the top cover 28, and raises the stopper 46. Thereby, the image forming apparatus 1 stops the contact point holder 38 in the contact point withdrawn state from moving in the exposure direction, and shifts the stopper 46 from the holder movement allowed state to the holder movement restricted state.

In other words, the image forming apparatus 1 shifts the second contact parts 34 of the main body from the contact point exposed state to the contact point withdrawn state by use of a contact part withdrawing mechanism 60 including the front cover lever 54, the release lever 56, the slider 40, the contact point frame 42 and the contact point holder 38. The image forming apparatus 1 further shifts from the holder movement allowed state to the holder exposure movement restricted state by use of a contact part withdrawal holding mechanism 62 including the first lever 50, the second lever 52 and the stopper 46. Thereby, the image forming apparatus 1 holds the second contact parts 34 of the main body in the contact point withdrawn state to prevent the second contact parts 34 of the main body from returning to the contact point exposed state. The combination of the first lever 50 and the second lever 52 is hereinafter referred to as a top cover drive transmitting mechanism as a second cover drive transmitting mechanism 64 which drives the stopper 46 along with the turn of the top cover 28.

Thus, the image forming apparatus 1 can hold the second contact parts 34 of the main body in the contact point withdrawn state, even when the front cover 29 is closed from the two-cover opened state before the top cover 28 despite the expected sequence in which the top cover 28 is closed before the front cover 29. When the top cover 28 is closed from the top cover opened state and the basket 30 shifts from the displaced position to the image forming position, therefore, the image forming apparatus 1 can prevent the image forming units 18 and the basket 30 from abrading the second contact parts 34 of the main body. Thus, the image forming apparatus 1 can prevent abrasion of the second contact parts 34 of the main body, adhesion of abrasion powder, deformation of the contact parts, and the like which are caused by the sliding between components other than the first contact parts 32 of the image forming section and the second contact parts 34 of the main body. Thereby, the image forming apparatus 1 can enhance its own reliability and extend its own life.

Moreover, the image forming apparatus 1 shifts the second contact parts 34 of the main body between the contact point exposed state and the contact point withdrawn state along with manipulations of opening and closing the front cover 29, and shifts the stopper 46 between the holder movement allowed state and the holder movement restricted state along with manipulations of opening and closing the top cover 28. Thus, when the user opens the front cover 29 and the top cover 28 as a manipulation needed for the user to access the inside of the printer housing 2, the image forming apparatus 1 can shift the second contact parts 34 of the main body from the contact point exposed state to the contact point withdrawn state, and the stopper 46 from the holder movement allowed state to the holder movement restricted states, without forcing the user to carry out additional laborious manipulations such as the manipulating of a lever and the like after opening the front cover 29 for the purpose of shifting the second contact parts 34 of the main body from the contact point exposed state to the contact point withdrawn state, and the manipulating of a lever and the like after opening the top cover 28 for the purpose of shifting the stopper 46 from the holder movement allowed state to the holder movement restricted state.

As discussed above, the image forming apparatus 1 according to an embodiment includes: the printer housing 2 including the internal space; the front cover 29 provided to the printer housing 2, to open and close the front opening 2FA; the top cover 28 provided to the printer housing 2, to open and close the upper opening 2BA; the image forming section 17 provided inside the printer housing 2, configured to form the latent image, and including the first contact parts 32; the second contact parts 34 provided to the printer housing 2, facing the first contact parts 32 of the image forming section, and that are brought into contact with the first contact parts 32; the contact part withdrawing mechanism 60 that is operated along with the movements of the front cover 29, and that brings the second contact parts 34 away from and in contact with the first contact parts 32; and the contact part withdrawal holding mechanism 62 that moves along with the top cover 28, and that holds the separation of the second contact parts 34 from the first contact parts 32.

Thereby, along with a manipulation of opening the front cover 29, the image forming apparatus 1 causes the contact part withdrawing mechanism 60 to withdraw the second contact parts 34 of the main body from the movement track of the image forming units 18 and the basket 30, and puts the second contact parts 34 of the main body into the contact point withdrawn state. In addition, along with a manipulation of opening the top cover 28, the image forming apparatus 1 causes the contact part withdrawal holding mechanism 62 to hold the second contact parts 34 of the main body in the contact point withdrawn state. Thus, even in the case where the front cover 29 is closed while the top cover 28 is opened, the image forming apparatus 1 can hold the second contact parts 34 in the contact point withdrawn state. Hence, the image forming apparatus 1 can securely prevent the second contact parts 34 of the main body from coming into contact with the image forming units 18 and the basket 30, no matter which sequence the front cover 29 and the top cover 28 are closed in.

2. Other Embodiments

The above one or more embodiments has discussed the case where the slider 40 becomes movable along with the front cover 29 while the basket 30 becomes movable along with the top cover 28. However, the invention is not limited to this. An embodiment or a modification may be such that the basket 30 becomes movable along with the front cover 29 while the slider 40 becomes movable along with the top cover 28.

In addition, the above one or more embodiments has discussed the case where the slider 40 moves the contact point holder 38 by reciprocating in the front-rear direction. However, the invention is not limited to this. An embodiment or a modification may be such that the slider 40 moves the contact point holder 38 by any other movement such as rotation. The point is that along with the movement of the front cover 29, the contact part withdrawing mechanism 60 may shift the second contact parts 34 of the main body between the contact point exposed state and the contact point withdrawn state.

Furthermore, the above one or more embodiments has discussed the case where the basket 30 movable along with the top cover 28 comes into contact with the first lever 50. However, the invention is not limited to this. An embodiment or a modification may be such that the top cover 28 comes into contact with the first lever 50 directly, that is to say, with no basket 30 interposed in between.

Moreover, the above one or more embodiments has discussed the case where the stopper 46 allows or restricts the movement of the contact point holder 38 by reciprocating in the up-down direction. However, the invention is not limited to this. An embodiment or a modification may be such that the stopper 46 allows or restricts the movement of the contact point holder 38 by any other movement such as rotation. The point is that along with the movement of the top cover 28, the contact part withdrawal holding mechanism 62 may shift the contact point holder 38 between the holder movement allowed state and the holder movement restricted state.

Besides, the above one or more embodiments has discussed the case where the biasing member (not illustrated) biases the first lever 50 in the clockwise direction in FIG. 16. However, the invention is not limited to this. An embodiment or a modification may be such that the weight of the second lever contact part 50*c* turns the first lever 50.

In addition, the above one or more embodiments has discussed the case where the second contact parts 34 of the main body and the first contact parts 32 of the image forming section are metal-made electrical contact parts which transmit electrical power from the second contact parts 34 of the main body to the first contact parts 32 of the image forming section. However, the invention is not limited to this. An embodiment or a modification may be such that the above one or more embodiments is applied to physical contacts which transmit driving force from the printer housing 2 to the image forming section 17 in the image forming apparatus 1.

Furthermore, the above one or more embodiment has discussed the case where the one or more embodiments is applied to the image forming apparatus 1 of tandem type in which the image forming units 18 are arranged in a line in the front-rear direction. However, the invention is not limited to this. An embodiment or a modification may be such that the above one or more embodiment is applied to a color printer using another method, for example a four-cycle method.

Moreover, the above one or more embodiments has discussed the case where the image forming apparatus 1 is a printer. However, the invention is not limited to this. An embodiment or a modification may be such that the image forming apparatus 1 is applied to an apparatus such as a facsimile machine, a multi-function printer (MFP) and a copying machine.

Besides, the above one or more embodiments has discussed the case where the image forming apparatus 1 as an image forming apparatus includes: the printer housing 2 as an apparatus housing; the front cover 29 as a first cover; the top cover 28 as a second cover; the image forming section 17 as an image forming section; the second contact parts 34 as second contact parts; the contact part withdrawing mechanism 60 as a contact part withdrawing mechanism; and the contact part withdrawal holding mechanism 62 as a contact part withdrawal holding mechanism. However, the invention is not limited to this. An embodiment or a modification may be such that an image forming apparatus includes an apparatus housing, a first cover, a second cover, an image forming section, second contact points, a contact part withdrawing mechanism and a contact part withdrawal holding mechanism which have configurations different from those of the image forming apparatus.

The invention includes other embodiments in addition to the above-described one or more embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image forming apparatus comprising:

an apparatus body including a housing that includes an internal space, a first opening and a second opening;

a first cover that is attached to the apparatus body, to open and close the first opening;

a second cover that is attached to the apparatus body, to open and close the second opening;

an image forming section that is provided inside the apparatus body and configured to form a latent image, and includes a first contact part;

a second contact part that is provided to the apparatus body, and is opposed to the first contact part;

a withdrawing mechanism that moves along with movement of the first cover, to bring the second contact part into contact with the first contact part and withdraw the second contact part to separate the second contact part away from the first contact part; and a withdrawal holding mechanism that moves along with movement of the second cover, and holds the separation of the second contact part from the first contact part, wherein the withdrawing mechanism separates the second contact part from the first contact part in a state where the first cover is opened, and the withdrawal holding mechanism holds the separation of the second contact part from the first contact part in a state where the second cover is opened.

2. The image forming apparatus according to claim 1, wherein the second contact part and the first contact part are electrical contact parts to transmit electrical power from the second contact part to the first contact part.

3. The image forming apparatus according to claim 1, wherein the withdrawal holding mechanism makes the second contact part movable relative to the first contact part when the second cover is closed from a state in which the second cover is opened, and the withdrawing mechanism brings the second contact part close to and into contact with the first contact part when the first cover is closed from a state in which the first cover is opened.

4. The image forming apparatus according to claim 1, wherein the withdrawal holding mechanism holds the separation of the second contact part from the first contact part in a case where the first cover is closed, before the second cover is closed, from a state in which the first cover and the second cover are opened.

5. The image forming apparatus according to claim 1, wherein the withdrawal holding mechanism makes the second contact part movable to the first contact part in a case where the second cover is closed, after the first cover is closed, from a state in which the first cover and the second cover are opened.

6. The image forming apparatus according to claim 1, further comprising a support member that supports the image forming section, and is movable between the internal space and an external space of the apparatus body.

7. The image forming apparatus according to claim 6, wherein the support member is movable, along with movement of the second cover, at least between an image forming position at which to form an image on a medium and a displaced position to which the support member is displaced upward from the image forming position, and the withdrawal holding mechanism holds the separation of the second contact part from the first contact part along with movement of the support member from the image forming position to the displaced position, and makes the second contact part movable relative to the first contact part along with movement of the support member from the displaced position to the image forming position.

8. The image forming apparatus according to claim 7, wherein the withdrawing mechanism brings the second contact part into contact with and separated away from the first contact part and the support member, and the withdrawal holding mechanism holds separation of the second contact part from a movement track of the first contact part and the support member, when the support member moves from the displaced position to the image forming position.

9. The image forming apparatus according to claim 1, wherein the withdrawing mechanism includes at least a slider that moves along with the first cover, and a contact point holder that moves along with the slider, and brings the second contact part into contact with and separated away from the first contact part, and the withdrawal holding mechanism includes at least a second cover drive transmitting mechanism that moves along with movement of the second cover, and a stopper that moves along with the second cover drive transmitting mechanism to hold and release the separation of the second contact part from the first contact part.

10. The image forming apparatus according to claim 9, wherein the slider includes a rib such that the slider moves, when the first cover is opened, in a first direction to push the contact point holder by the rib, in a direction in which the second contact part is withdrawn from the first contact part, and the second cover drive transmitting mechanism moves, when the second cover is opened, the stopper toward the first contact part beyond the contact point holder.

11. The image forming apparatus according to claim 10, wherein the rib includes an inclined surface that comes into contact with the contact point holder, and along with the movement of the slider in the first direction, the contact point holder moves along the inclined surface in a direction of separating the second contact part.

12. The image forming apparatus according to claim 10, further comprising a biasing member that biases the stopper to the first contact part, wherein the second cover drive transmitting mechanism includes a movement restricting part that restricts movement of the stopper to the first contact part in a state where the second cover is closed.

13. The image forming apparatus according to claim 6, wherein the first cover is provided on a front surface of the apparatus body, the second cover is provided on a top surface of the apparatus body, and the support member is movable between a front side of the apparatus body and the internal space in a state where the first cover is opened, and makes the image forming section attachable to and detachable from the support member in a state where the support member is pulled out to the front side of the apparatus body.

14. An image forming apparatus comprising:

an apparatus body including a housing that includes an internal space, a first opening and a second opening;

a first cover that is attached to the apparatus body, to open and close the first opening;

a second cover that is attached to the apparatus body, to open and close the second opening;

an image forming section that is provided inside the apparatus body and configured to form a latent image, and includes a first contact part;

a second contact part that is provided to the apparatus body, and is opposed to the first contact part;

a withdrawing mechanism that moves along with movement of the first cover, to bring the second contact part into contact with the first contact part and withdraw the second contact part to separate the second contact part away from the first contact part; and a withdrawal holding mechanism that moves along with movement of the second cover, and holds the separation of the second contact part from the first contact part, wherein the withdrawal holding mechanism makes the second contact part movable relative to the first contact part when the second cover is closed from a state in which the second cover is opened, and the withdrawing mechanism brings the second contact part close to and into contact with the first contact part when the first cover is closed from a state in which the first cover is opened.

15. An image forming apparatus comprising:

an apparatus body including a housing that includes an internal space, a first opening and a second opening;

a first cover that is attached to the apparatus body, to open and close the first opening;

a second cover that is attached to the apparatus body, to open and close the second opening;

an image forming section that is provided inside the apparatus body and configured to form a latent image, and includes a first contact part;

a second contact part that is provided to the apparatus body, and is opposed to the first contact part;

a withdrawing mechanism that moves along with movement of the first cover, to bring the second contact part into contact with the first contact part and withdraw the second contact part to separate the second contact part away from the first contact part; and a withdrawal holding mechanism that moves along with movement of the second cover, and holds the separation of the second contact part from the first contact part, wherein the withdrawal holding mechanism holds the separation of the second contact part from the first contact part in a case where the first cover is closed, before the second cover is closed, from a state in which the first cover and the second cover are opened.

* * * * *